US007907111B2

(12) United States Patent
Fujita

(10) Patent No.: US 7,907,111 B2
(45) Date of Patent: Mar. 15, 2011

(54) DRIVING CIRCUIT, LIQUID CRYSTAL DEVICE, ELECTRONIC APPARATUS, AND METHOD OF DRIVING LIQUID CRYSTAL DEVICE

(75) Inventor: Shin Fujita, Suwa (JP)

(73) Assignee: Epson Imaging Devices Corporation, Azumino-shi (JP)

( * ) Notice: Subject to any disclaimer, the term of this patent is extended or adjusted under 35 U.S.C. 154(b) by 781 days.

(21) Appl. No.: 11/892,624

(22) Filed: Aug. 24, 2007

(65) Prior Publication Data

US 2008/0074377 A1 Mar. 27, 2008

(30) Foreign Application Priority Data

Sep. 26, 2006 (JP) ..... 2006-261101

(51) Int. Cl.
*G09G 3/36* (2006.01)

(52) U.S. Cl. ..... 345/98; 345/94; 345/96; 345/99; 345/100

(58) Field of Classification Search ..... 345/98, 345/94, 96, 99, 100, 87, 690
See application file for complete search history.

(56) References Cited

U.S. PATENT DOCUMENTS 5,805,247 A * 9/1998 Oh-e et al. ..... 349/42
6,897,845 B2 * 5/2005 Ozawa ..... 345/94
6,963,335 B2 11/2005 Tanaka et al.
2004/0178977 A1 * 9/2004 Nakayoshi et al. ..... 345/87
2005/0253829 A1 * 11/2005 Mamba et al. ..... 345/204
2008/0042963 A1 * 2/2008 Fujita ..... 345/98
2008/0079680 A1 * 4/2008 Fujita ..... 345/89
2009/0015533 A1 * 1/2009 Fujita et al. ..... 345/92

FOREIGN PATENT DOCUMENTS

JP A 2001-235763 8/2001
JP A-2002-072989 3/2002
JP A 2002-182230 6/2002
JP A 2002-196358 7/2002

* cited by examiner

*Primary Examiner* — Sumati Lefkowitz
*Assistant Examiner* — Seokyun Moon
(74) *Attorney, Agent, or Firm* — Oliff & Berridge, PLC

(57) ABSTRACT

A driving circuit for driving a liquid crystal device that has, a first substrate including a plurality of scanning lines, a plurality of data lines, and a plurality of pixel electrodes and a plurality of common electrodes, a second substrate disposed opposite the first substrate, and liquid crystal, the common electrodes being partitioned every horizontal line, the driving circuit includes: a control circuit that alternately supplies a first voltage and a second voltage being higher than the first voltage to the common electrodes and that sets the common electrodes to a floating state; a scanning line driving circuit that sequentially supplies a selection voltage to the plurality of scanning lines; and a data line driving circuit that alternately supplies a positive image signal having a potential higher than the first voltage and a negative image signal having a potential lower than the second voltage to the plurality of data lines.

6 Claims, 12 Drawing Sheets

SECTIONAL VIEW TAKEN ALONG LINE III-III

DRIVING CIRCUIT, LIQUID CRYSTAL DEVICE, ELECTRONIC APPARATUS, AND METHOD OF DRIVING LIQUID CRYSTAL DEVICE

BACKGROUND

1. Technical Field

The present invention relates to a driving circuit, a liquid crystal device, an electronic apparatus, and a method of driving the liquid crystal device.

2. Related Art

A liquid crystal device that displays an image using liquid crystal is known. Such a liquid crystal device, for example, includes a liquid crystal panel and a backlight arranged to be opposite the liquid crystal panel.

The liquid crystal panel includes a pair of substrates and liquid crystal interposed between the pair of substrates.

The liquid crystal panel includes a plurality of scanning lines and a plurality of capacitance lines alternately provided at every predetermined interval, and data lines crossing the plurality of scanning lines and the plurality of capacitance lines and being provided at every predetermined interval.

Pixels are provided at intersections of the scanning lines and the data lines. Each pixel includes a pixel capacitor having a pixel electrode and a common electrode, a thin film transistor (hereinafter, referred to as a TFT), and a storage capacitor of which one electrode is connected to the capacitance line and the other electrode is connected to the pixel electrode. The plurality of pixels are arranged in a matrix to form a display area.

A gate of the TFT is connected to the corresponding scanning line, a TFT source is connected to the corresponding data line, and a TFT drain is connected to the corresponding pixel electrode and the other corresponding electrode of the storage capacitor.

In the above-described liquid crystal panel, a scanning line driving circuit connected to the plurality of scanning lines, a data line driving circuit connected to the plurality of data lines, and a capacitance line driving circuit connected to the plurality of capacitance lines are provided.

The scanning line driving circuit sequentially supplies a selection voltage for selecting a scanning line to the plurality of scanning lines. For example, when supplying the selection voltage to any scanning line, the TFT connected to the corresponding scanning line is turned on and the pixel related to the corresponding scanning line is selected.

The data line driving circuit supplies an image signal to the plurality of data lines when the scanning lines are selected. An image voltage based on the image signal is applied to the pixel electrodes through TFTs in the ON state.

The data line driving circuit supplies the data lines with the image signal of which the voltage (hereinafter, referred to as a positive polarity) is higher than that of the common electrode and applies the image voltage based on the image signal of the positive polarity to the pixel electrodes. The data line driving circuit supplies the data lines with the image signal of which the voltage (hereinafter, referred to as a negative polarity) is lower than that of the common electrode and applies the image voltage based on the image signal of the negative polarity to the pixel electrodes. At this time, the data line driving circuit alternately performs application of a positive polarity voltage and application of a negative polarity voltage at every one horizontally scanning period.

The capacitance line driving circuit supplies a predetermined voltage to the capacitance lines.

The above-described liquid crystal device operates as follows.

The selection voltage is sequentially supplied to the scanning lines to turn TFTs connected to the scanning lines to the ON state and all of the pixels related to the scanning lines are selected. In addition, in synchronization with the selection of the pixels, the image signal is supplied to the data lines. Accordingly, the image signal is supplied to all the selected pixels through TFTs in the ON state and the image voltage based on the image signal is applied to the pixel electrodes.

When the image voltage is applied to the pixel electrodes, a potential difference between the pixel electrodes and the common electrodes induces a driving voltage to be applied to the liquid crystal. When the driving voltage is applied to the liquid crystal, alignment or order of molecules of the liquid crystal is changed, light transmitted through the liquid crystal from a backlight is changed, and a gray scale level is displayed.

The driving voltage is applied to the liquid crystal for an interval three orders of magnitude greater than the interval of time for which the image voltage is applied by the storage capacitors.

The above-described liquid crystal device is used for, for example, a portable apparatus. However, there has been recently a demand for reducing the power consumption of portable apparatuses. Accordingly, there has been suggested a liquid crystal device capable of having reduced power consumption by applying the image voltage to the pixel electrodes, and subsequently turning TFTs to an OFF state and changing the voltage of the capacitance lines (for example, see JP-A-2002-196358).

An operation of the liquid crystal device of the known example that changes the voltage of the capacitance lines in the manner described in JP-A-2002-196358 will be described with reference to FIGS. 13 and 14.

FIG. 13 is a timing chart illustrating an application of the positive polarity in the liquid crystal of the known example. FIG. 14 is a timing chart illustrating an application of the negative polarity in the liquid crystal of the known example.

For example, the liquid crystal device of the known example has scanning lines and capacitance lines of 320 rows and the data lines of 240 columns.

In FIGS. 13 and 14, GATE(j) denotes a voltage of the scanning line of a j-th row (where j is an integer satisfying $1 \leqq j \leqq 320$) and VST(j) denotes a voltage of the scanning line of the j-th row. SOURCE(k) denotes a voltage of the data line of a k-th row (where k is an integer satisfying $1 \leqq k \leqq 240$). PIX(j, K) denotes a voltage of the pixel electrode of a pixel in the j-th row and the k-th column corresponding to an intersection of the j-th scanning line and the k-th data line. VCOM denotes a voltage of the common electrode commonly provided to each pixel.

First, an operation of application of the positive polarity in the liquid crystal device of the known example will be described with reference to FIG. 13.

When the data line driving circuit supplies the selection voltage to the j-th scanning line at time t31, the voltage GATE(j) of the j-th scanning line increases, and thus becomes a voltage VGH at time t32. In this way, TFTs connected to the j-th scanning line all turn on.

When the data line driving circuit supplies the positive image signal to the k-th data line at time t33, the voltage SOURCE(k) of the k-th data line increases, and thus becomes a voltage VP8 at time t34.

The voltage SOURCE(k) of the k-th data line that is the image voltage based on the positive image signal is applied to the image electrode of the pixel in the j-th row and the k-th column through the ON state TFT connected to the j-th scanning line. For this reason, a voltage PIX(j, k) of the pixel electrode of the pixel in the j-th row and the k-th column increases, and thus becomes the voltage VP8 at time t34, which is the same as the voltage SOURCE (k) of the k-th data line.

When the scanning line driving circuit stops supplying the selection voltage to the j-th scanning line at time t35, the voltage GATE(j) of the j-th scanning line decreases, and thus becomes the voltage VGL at time t36. In this way, TFTs connected to the j-th scanning line all enter the OFF state.

When the capacitance line driving circuit supplies a predetermined voltage to the j-th capacitance line at time t36, a voltage VST(j) of the j-th capacitance line increases, and thus becomes a voltage VSTH at time t37.

When the voltage VST(j) of the j-th capacitance line increases, charges corresponding to the increased voltage are distributed to the storage capacitors and the pixel capacitors in all pixels related to the j-th capacitance line. For this reason, the voltage PIX(j, k) of the pixel electrode of the pixel in the j-th row and the k-th column increases, and thus becomes a voltage VP9 at time t37.

That is, in the liquid crystal device of the known example, when the positive polarity is applied, the image voltage based on the image signal of the positive polarity is applied to the pixel electrodes, and then the voltage of the capacitance lines is increased. At this time, the voltage of the pixel electrodes increases by as much as a sum of a voltage increased by the charges corresponding to the voltage increased by the image voltage and the increased voltage of the capacitance lines, referring to the voltage of the common electrodes.

Next, an operation of application of the negative polarity in the liquid crystal device of the known example will be described with reference to FIG. 14.

When the scanning line driving circuit supplies the selection voltage to the j-th scanning line at time t41, the voltage GATE(j) of the j-th scanning line increases, and thus becomes the voltage VGH at time t42. In this way, TFTs connected to the j-th scanning line all turn on.

When the data line driving circuit supplies the image signal of the negative polarity to the k-th data line at time t43, the voltage SOURCE(k) of the k-th data line decreases, and thus becomes a voltage VP11 at time t44.

The voltage SOURCE(k) of the k-th data line that is the image voltage based on the image signal of the negative polarity is applied to the image electrode of the pixel in the-j row and the k-th column through the ON state TFT connected to the j-th scanning line. For this reason, the voltage PIX(j, k) of the pixel electrode of the pixel in the j-th row and the k-th column decreases, and thus becomes a voltage VP11 at time t44, which is the same as the voltage SOURCE(k) of the k-th data line.

When the scanning line driving circuit stops supplying the selection voltage to the j-th scanning line at time t45, the voltage GATE(j) of the j-th scanning line decreases, and thus becomes a voltage VGL at time t46. In this way, TFTs connected to the j-th scanning line all turn off.

When the capacitance line driving circuit supplies a predetermined voltage to the j-th capacitance line at time t46, the voltage VST(j) of the j-th capacitance line decreases, and thus becomes a voltage VSTL at time t47.

When voltage VST(j) of the j-th capacitance line decreases, charges corresponding to the decreased voltage are distributed to the storage capacitors and the pixel capacitors in all pixels related to the j-th capacitance line. For this reason, the voltage PIX(j, k) of the pixel electrode of the pixel in the j-th row and the k-th column decreases, and thus becomes a voltage VP10 at time t47.

That is, in the liquid crystal device of the known example, when the negative polarity is applied, the image voltage based on the image signal of the negative polarity is applied to the pixel electrodes, and then the voltage of the capacitance lines is increased. At this time, the voltage of the pixel electrodes increases by as much as a sum of a voltage decreased by the charges corresponding to the voltage decreased by the image voltage and the decreased voltage of the capacitance lines, referring to the voltage of the common electrodes.

In the liquid crystal device as described in the known example, even when an amplitude of the image voltage is reduced, a potential difference between the voltage of the common electrodes and the voltage of the pixel electrodes can be increased by applying the image voltage to the image electrodes and changing the voltage of the capacitance lines. As a result, a display quality can be prevented from being deteriorated by guaranteeing the amplitude of the driving voltage applied to the liquid crystal and the consumption power can be reduced by reducing the amplitude of the image voltage.

In the liquid crystal device as described above in the known example, the voltage of the capacitance lines is changed and the charges are moved between the storage capacitors and the pixel capacitors to change the voltage of the pixel electrodes. For this reason, when irregularity in characteristics occurs among the storage capacitors, an amount of the charges moving between the storage capacitors and the pixel capacitors is affected. Even when the same image voltage is applied to the pixel electrodes, the irregularities can happen in the voltages of the pixel electrodes. Accordingly, irregularities can happen in a gray scale level of the pixels, thereby deteriorating the display quality.

Further, in the liquid crystal device as described in the known example, since the voltage of the capacitance lines is changed to be different from that of the pixel electrodes or the common electrodes, one electrode of the storage capacitors connected to the capacitance lines is required to be separately formed from the pixel electrodes or the common electrodes. For this reason, in liquid crystal devices using modes such as In-Plane Switching (IPS) and Fringe-Field Switching (FFS) in which the pixel electrodes and the common electrodes constituting the pixel capacitors are provided on one substrate of a pair of substrates with liquid crystal interposed therebetween and the pixel capacitors and the storage capacitors are incorporated, it is difficult to form the liquid crystal device as described in the above-described in the known example.

SUMMARY

An advantage of some aspects of the invention is that it provides a driving circuit, a liquid crystal device, an electronic apparatus, and a method of driving the liquid crystal device capable of preventing a display quality from being deteriorated and reducing a consumption power in the liquid crystal device including pixel electrodes and common electrodes constituting pixel capacitors on one substrate of a pair of substrates with liquid crystal interposed therebetween.

According to an aspect of the invention, there is provided a driving circuit for driving a liquid crystal device that has, a first substrate including a plurality of scanning lines, a plurality of data lines, and a plurality of pixel electrodes and a plurality of common electrodes arranged to correspond to intersections between the plurality of scanning lines and the plurality of data lines, a second substrate disposed opposite the first substrate, and liquid crystal interposed between the first substrate and the second substrate, the common electrodes being partitioned every horizontal line, the driving circuit including: a control circuit that alternately supplies a first voltage and a second voltage being higher than the first voltage to the common electrodes at a predetermined interval of time and that sets the common electrodes to a floating state; a scanning line driving circuit that sequentially supplies a selection voltage for selecting a scanning line to the plurality of scanning lines; and a data line driving circuit that alternately supplies a positive image signal having a potential higher than the first voltage and a negative image signal having a potential lower than the second voltage to the plurality of data lines at a predetermined interval of time when the scanning lines are selected, wherein the control circuit supplies the first voltage to the common electrodes and sets at least one common electrode among the common electrodes adjacent to the common electrode supplied with the first voltage to the floating state, then the scanning line driving circuit supplies the selection voltage to the scanning lines, and the data line driving circuit supplies the positive image signal to the data lines; and wherein the control circuit supplies the second voltage to the common electrodes and sets at least one common electrode among the common electrodes adjacent to the common electrodes supplied with the second voltage to the floating state, then the scanning line driving circuit supplies the selection voltage to the scanning lines, and the data line driving circuit supplies the negative image signal to the data lines.

According to this configuration, after the first voltage is applied to the common electrodes, application of the positive polarity is performed, and after the second voltage is applied to the common electrodes, application of the negative polarity is performed. For this reason, as described in the known example, the charges do not move between the storage capacitors and the pixel capacitors. Accordingly, even when irregularity in characteristic happens, the irregularity does not happen in the voltage of the pixel electrodes. As a result, the irregularity can be prevented in a gray scale level of each pixel, thereby preventing a display quality from being deteriorated.

According to this configuration, the voltage of the common electrodes is changed to the first voltage or the second voltage. For this reason, as described in the known example, it is not necessary to change the voltage of each capacitance line connected to one electrode of each storage capacitor differently from the voltage of the each pixel electrode and each common electrode included by the corresponding pixel capacitor. That is, since the voltage of the one electrode of each storage capacitor can be changed similarly with the voltage of each common electrode, the one electrode of each storage capacitor and each common electrode can be incorporated. Moreover, since the other electrode of each storage capacitor is connected to the corresponding pixel electrode, as described above, the potential of the other electrode of each storage capacitor is the same as that of the corresponding pixel electrode, and thus the other electrode of each storage capacitor and the corresponding pixel electrode can be incorporated. As a result, since the storage capacitors and the pixel electrodes can be incorporated, it is possible to embody the liquid crystal device according to the invention including the pixel electrodes and the common electrodes constituting the pixel capacitors on a first substrate of the first substrate and a second substrate which are a pair of the substrates with the liquid crystal interposed therebetween.

For example, in a first common electrode and a second common electrode adjacent to each other, when a voltage is applied to the first common electrode, a voltage of the second common electrode is fixed. Accordingly, a capacitive coupling with the second common electrode interferes with a change in the voltage of the first common electrode. At this time, since the time required to change the voltage of the first common electrode to the predetermined voltage becomes longer after supplying the voltage to the first common electrode, the display quality may be deteriorated.

According to this configuration, the common electrodes are provided to be partitioned every horizontal line. In addition, the control circuit supplies the first voltage or the second voltage to the common electrodes and at least one common electrode among the common electrodes adjacent to the common electrodes supplied with the second voltage is set to a floating state. That is, when the first voltage or the second voltage is supplied to the common electrodes, at least one common electrode among the common electrodes adjacent to the common electrodes supplied with the voltage is set to the floating state. For this reason, the capacitive coupling occurs between the common electrodes supplied with the first voltage or the second voltage and the common electrodes in the floating state. However, since the common electrodes of one side are in the floating state, interfering with the change in the voltage of the common electrodes supplied with the first voltage and the second voltage becomes small. Accordingly, when the first voltage or the second voltage is supplied to the common electrodes, the time required to change the voltage of the common electrodes to the predetermined voltage can be prevented from being longer, thereby further preventing the display quality from being deteriorated. Moreover, when the common electrodes are set to the floating state, the supply of the voltage to the common electrodes stops. As a result, it is possible to reduce the consumption power.

In the driving circuit, the control circuit may include a plurality of unit control circuits which are provided to correspond the plurality of plurality of the scanning lines and which is supplied with a polarity signal for selecting the first voltage or the second; and wherein each unit control circuit includes: a latch circuit that maintains the polarity signal when the scanning lines driving circuit supplies the selection voltage to the scanning line adjacent to the scanning line corresponding to the unit control circuits; a selection circuit that selectively outputs one of the first voltage and the second voltage on the basis of the polarity signal maintained by the latch circuit; and a switching circuit that electrically connects the selection circuit to the common electrode when one of the first voltage and the second voltage output from the selection circuit is supplied to the common electrodes, and electrically disconnect the selection circuit from the common electrodes when the common electrodes are set to the floating state.

According to this configuration, the plurality of unit control circuits are provided in the control circuit in correspondence with the plurality of scanning lines. A latch circuit, a selection circuit, and a switching circuit are provided to each unit control circuit. For this reason, the control circuit can select the first voltage or the second voltage to supply it to each common electrode or set each common electrode to the floating state. As a result, the same advantages as described above are gained.

According to another aspect of the invention, there is provided a liquid crystal device including the above-described driving circuit having.

According to this configuration, the same advantages as described above are gained.

According to still another aspect of the invention, there is provided an electronic apparatus including the above-described liquid crystal device.

According to this configuration, the same advantages as described above are gained.

According to still another aspect of the invention, there is provided a method of driving a liquid crystal device that has a first substrate including a plurality of scanning lines, a plurality of data lines, a plurality of pixel electrodes and a plurality of common electrodes arranged to correspond to intersections between the plurality of scanning lines and the plurality of data lines, a second substrate disposed opposite the first substrate, and liquid crystal interposed between the first substrate and the second substrate, wherein a control circuit for alternately supplying a first voltage and a second voltage being higher than the first voltage to the common electrodes at a predetermined interval of time and for setting the common electrodes to a floating state; a scanning line driving circuit for sequentially supplying a selection voltage for selecting a scanning line to the plurality of scanning lines; and a data line driving circuit for alternately supplying a positive image signal having a potential higher than the first voltage and a negative image signal having a potential lower than the second voltage to the plurality of data lines at a predetermined interval of time when selecting the scanning lines are provided, the method including: a positive polarity applying sequence in which the control circuit supplies the first voltage to the common electrodes and sets at least one common electrode among the common electrodes adjacent to the common electrode supplied with the first voltage to the floating state, then the scanning line driving circuit supplies the selection voltage to the scanning lines and the data line driving circuit supplies the positive image signal to the data lines; and a negative applying sequence in which the control circuit supplies the second voltage to the common electrodes and sets at least one common electrode among the common electrodes adjacent to the common electrode supplied with the second voltage to the floating state, then the scanning line driving circuit supplies the selection voltage to the scanning lines, and the data line driving circuit supplies the negative image signal to the data lines.

According to this configuration, the same advantages as described above are gained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
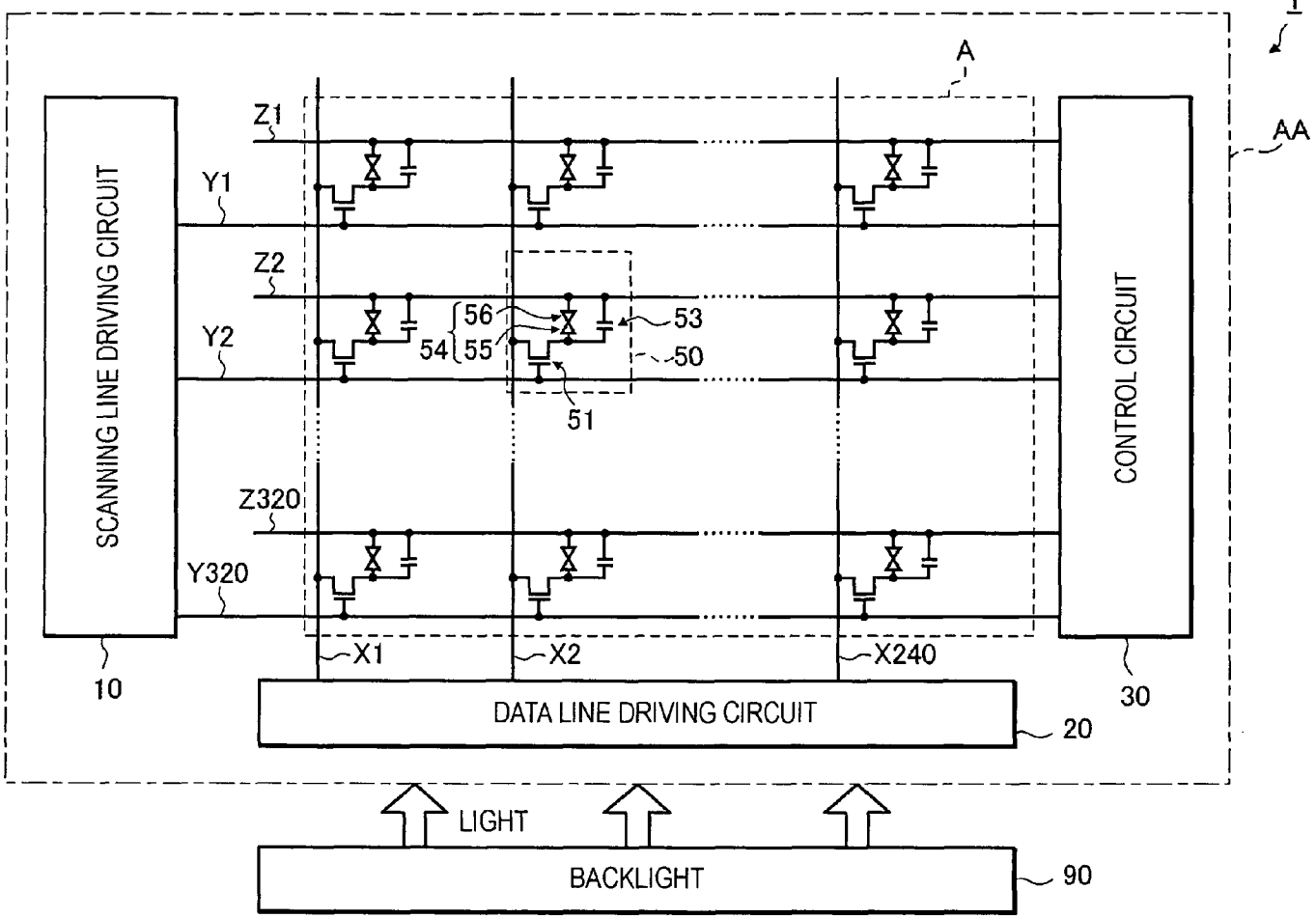
FIG. 1 is a block diagram illustrating a liquid crystal device according to a first embodiment of the invention.

Hereinafter, embodiments of the invention will be described with reference to the drawings. In the description of the following embodiments and modified example, the same reference numerals and symbols are given to the same constituents and repeated description thereof will be omitted or simplified.

First Embodiment

FIG. 1 is a block diagram illustrating a liquid crystal device 1 according to a first embodiment of the invention.

The liquid crystal device 1 includes a liquid crystal panel AA and a backlight 90 which is disposed opposite the liquid crystal panel AA and emits light. The liquid crystal device 1 performs transmissive display using light emitted from the backlight 90.

In the liquid crystal panel AA, a display screen A in which a plurality of pixels 50 are arranged in a matrix to display an image is provided, and a scanning line driving circuit 10, a data line driving circuit 20, and a control circuit 30 are arranged in a periphery of the display screen A and are driving circuits for driving the liquid crystal device 1.

The backlight 90 emits light. The backlight 90 is arranged in the rear surface of the liquid crystal panel AA and is formed of a cold cathode fluorescent lamp (CCFL), a light emitting diode (LED), or an electro luminescence (EL) element.

Hereinafter, a configuration of the liquid crystal panel AA will be described in detail.

In the liquid crystal panel AA, 320 scanning lines Y1 to Y320 and 320 common lines Z1 to Z320 alternately arranged at every predetermined interval are provided in a horizontal direction. In addition, 240 data lines X1 to X240 which cross the scanning lines Y1 to Y320 and the common lines Z1 and Z320 and are arranged at every predetermined interval are provided vertically.

The pixels 50 are arranged at intersections of the scanning lines Y and the data lines X. Each pixel 50 includes a TFT 51, a pixel capacitor 54 having a pixel electrode 55 and a common electrode 56, and a storage capacitor 53 of which one electrode is connected to the common line Z and the other electrode is connected to the pixel electrode 55.

The common electrodes 56 are electrically partitioned every horizontal line and each common electrode 56 is connected to the corresponding common line Z.

A gate of each TFT 51 is connected to the corresponding scanning line Y and a source of each TFT 51 is connected to the corresponding data line X. A drain of each TFT 51 is connected to the corresponding pixel electrode 55 and the other electrode of the corresponding storage capacitor 53. With a selection voltage applied from the scanning lines Y, TFTs 51 turn on and the data lines X, allow the pixel electrodes 55, and the other electrodes of the storage capacitors 53 to enter a conductive state.

Figure 2:
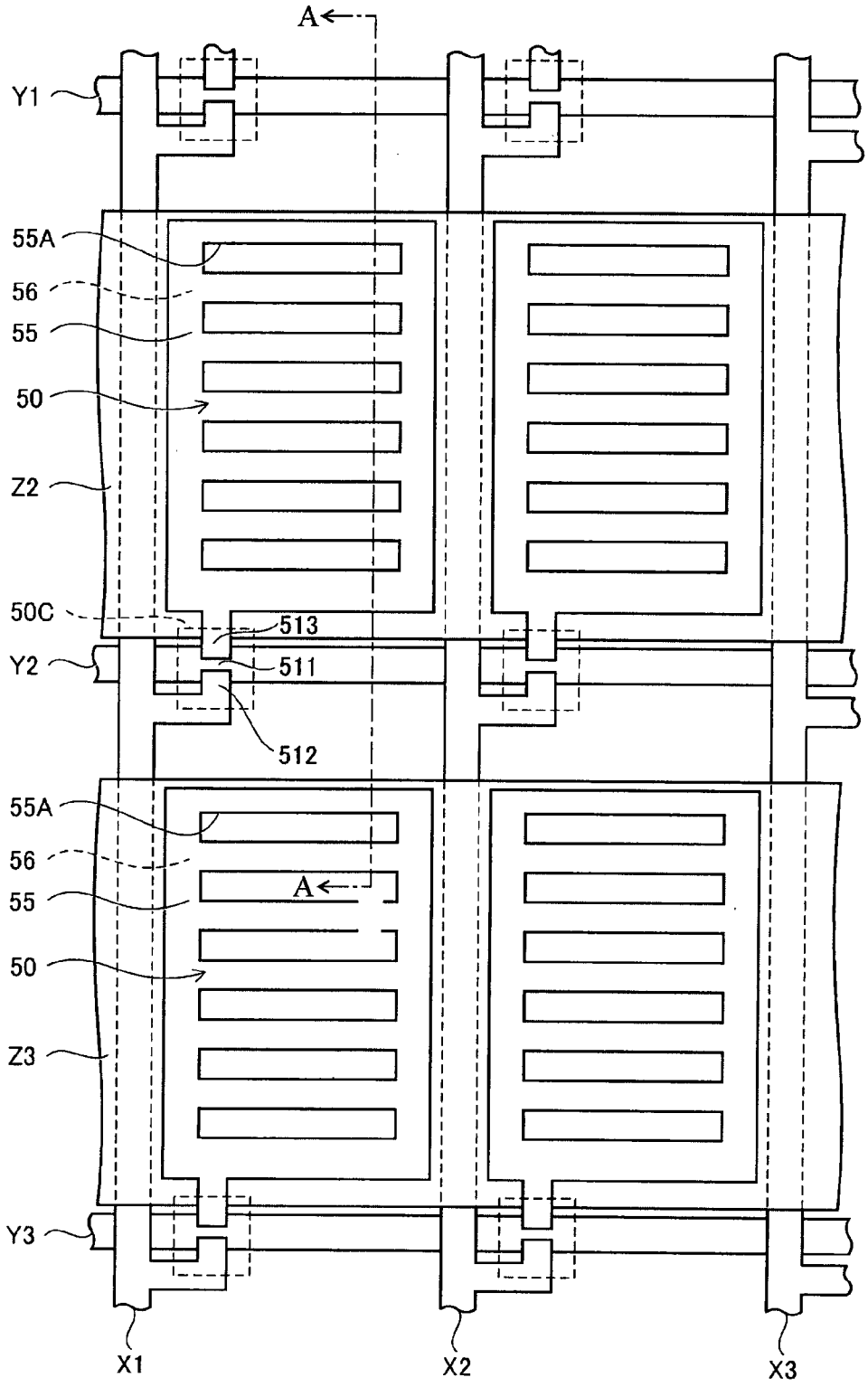
FIG. 2 is an enlarged top view illustrating pixels included by the liquid crystal device.
Figure 3:
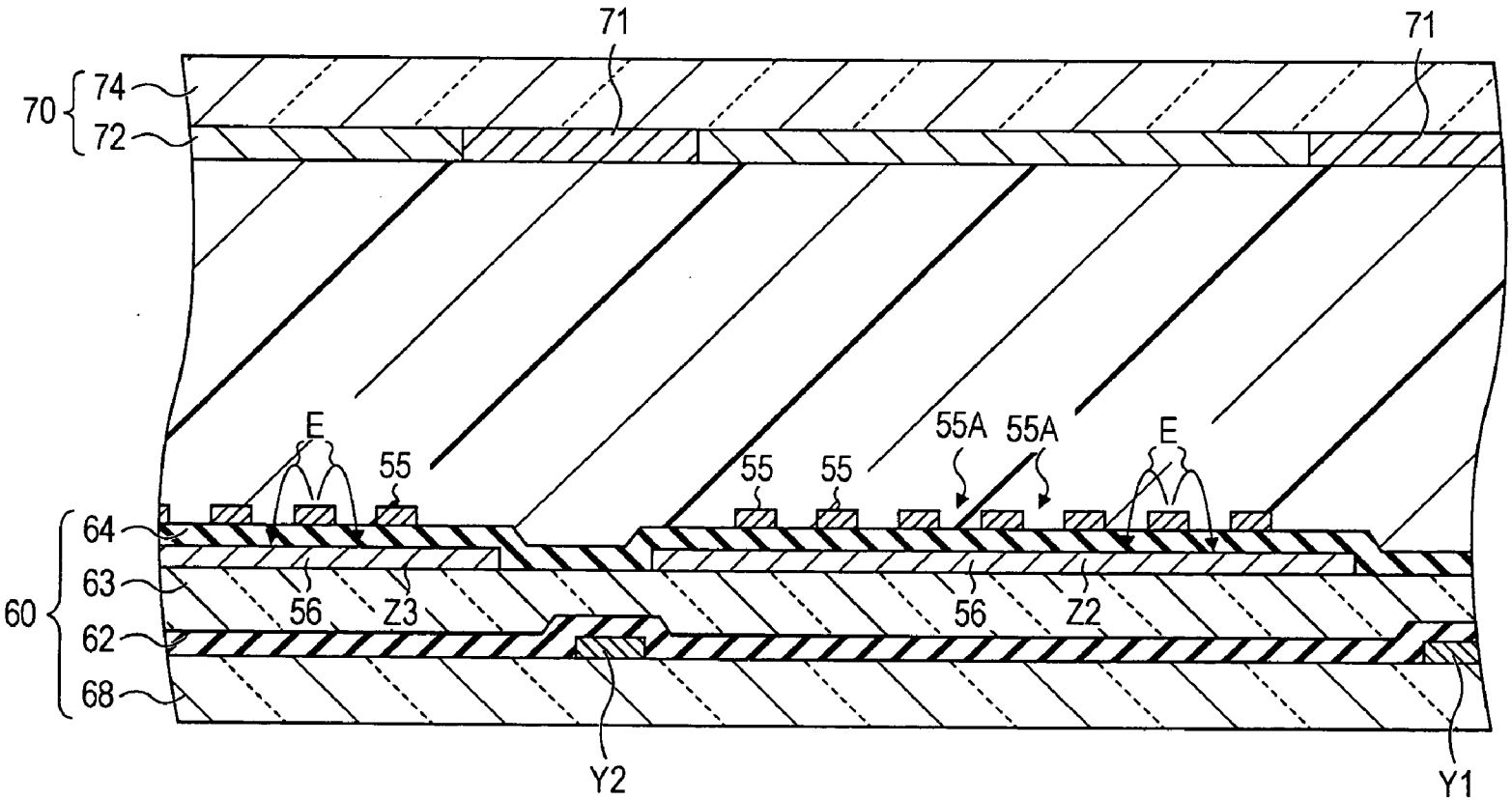
FIG. 3 is a sectional view illustrating the pixels.

FIG. 2 is an enlarged top view illustrating the pixels 50. FIG. 3 is a sectional view illustrating the pixels 50 taken along the line III-III shown in FIG. 2.

The liquid crystal panel AA includes an element substrate 60 that is a first substrate, a counter substrate 70 that is a second substrate and is disposed opposite the element substrate 60, and liquid crystal that is interposed between the element substrate 60 and the counter substrate 70. The liquid crystal operates in a normally black mode.

In the element substrate 60, the scanning lines Y1 to Y320, the common lines Z1 to Z320, and the data lines X1 to X240 are arranged. Each pixel 50 is formed in an area surrounded by two mutually adjacent scanning lines Y and two mutually adjacent data lines X. That is, the pixels 50 are partitioned by the scanning lines Y and the data lines X.

In this embodiment, each TFT 51 is an inverse staggered amorphous silicon TFT and an area 50C (area surrounded by a dashed line shown in FIG. 2) in which a TFT 51 is formed is provided in the vicinity of each intersection of the scanning lines Y and the data lines X.

First, the element substrate 60 will be described.

The element substrate 60 includes a glass substrate 68. On the glass substrate 68, a ground insulating film (not shown) is formed across the entire surface of the element substrate 60 in order to prevent TFTs 51 from being deteriorated due to roughness or strain of the surface of the glass substrate 68.

The scanning lines Y made of a conductive material are formed on the ground insulating film.

The scanning lines Y are arranged along the boundary of the adjacent pixels 50 and gate electrodes 511 of TFTs 51 are formed in the vicinity of the intersections of the scanning lines Y and the data lines X.

On the scanning lines Y, the gate electrodes 511, and the ground insulating film, a gate insulating film 62 is formed across the entire surface of the element substrate 60.

In the areas 50C in which TFTs 51 on the gate insulating film 62 are formed, a semiconductor layer (not shown) made of amorphous silicon and an ohmic contact layer (not shown) made of N+amorphous silicon are laminated to be opposite the gate electrodes 511. Source electrodes 512 and drain electrodes 513 are laminated on the ohmic contact layer, and the amorphous silicon TFTs are formed in this way.

The source electrodes 512 are formed of the same conductive material as the data lines X. That is, the source electrodes 512 extend from the data lines X. The data lines X and the scanning lines Y cross each other.

As described above, the gate insulating film 62 is formed on the scanning lines Y and the data lines X are formed on the gate insulating film 62. Accordingly, the data lines X are insulated from the scanning lines Y by the gate insulating film 62.

On the data lines X, the source electrodes 512, the drain electrodes 513, and the gate insulating film 62, a first insulating film 63 is formed across the entire surface of the element substrate 60.

The common lines Z made of a transparent conductive material such as indium tin oxide (ITO) and indium zinc oxide (IZO) are formed on the first insulating film 63.

The common lines Z are formed along the scanning lines Y and the common electrodes 56 extend from the common lines Z.

On the common lines Z, the common electrodes 56, and the first insulating film 63, a second insulating film 64 is formed across the entire surface of the element substrate 60.

On the second insulating film 64, the pixel electrodes 55 made of the transparent conductive material such as ITO and IZO are formed on the areas opposite the common electrodes 56. The pixel electrodes 55 are electrically connected to the drain electrodes 513 through contact holes (not shown) formed in the first insulating film 63 and the second insulating film 64 described above.

A plurality of slits 55A are provided at every predetermined interval in the pixel electrodes 55 in order to generate a fringe field (an electric field E) between the pixel electrodes 55 and the corresponding common electrode 56. That is, the liquid crystal device 1 is an FFS-type liquid crystal device.

On the pixel electrodes 55 and the second insulating film 64, an alignment film (not shown) formed of an organic film such as a polyimide film is formed across the entire surface of the element substrate 60.

Next, the counter substrate 70 will be described.

The counter substrate 70 includes a glass substrate 74. As a block matrix, light-shielding films 71 are formed in areas on the glass substrate 74 opposite the scanning lines Y. Color filters 72 are formed on the areas on the glass substrate 74 other than the areas in which the light-shielding films 71 are formed.

On the light-shielding films 71 and the color filters 72, the alignment film (not shown) is formed across the entire surface of the counter substrate 70.

In FIG. 1, the control circuit 30 supplies a voltage VCOML, which is the first voltage or a voltage VCOMH, which is the second voltage and is higher than the voltage VCOML, to the common lines Z1 to Z320 or sets the common lines Z1 to Z320 to the floating state. For example, when the voltage VCOML is supplied to some of the common lines Z, a voltage of all common electrodes 56 connected to some of the common lines Z becomes the voltage VCOML.

The scanning line driving circuit 10 sequentially supplies the selection voltage for selecting each scanning line Y to the scanning lines Y1 to Y320. For example, when the selection voltage is supplied to some of the scanning lines Y, TFTs 51 connected to some of the scanning lines Y all turn to on and the pixels 50 related to some of the scanning lines Y are all selected.

Alternatively, during a time other than the supply of the selection voltage, the scanning line driving circuit 10 supplies a non-selection voltage for stopping the selection of the scanning lines Y to the scanning lines Y1 to Y320.

The data line driving circuit 20 supplies an image signal to the data lines X1 to X240 and applies an image voltage based on the image signal to the pixel electrodes 55 through the TFTs 51 in the ON state.

The data line driving circuit 20 supplies the data lines X with a positive image signal of which the voltage is higher than the voltage VCOML and applies the image voltage based on the positive image signal to the pixel electrodes 55. The data line driving circuit 20 supplies the data lines X with a negative image signal of which the voltage is lower than the voltage VCOMH and applies the image voltage based on the negative image signal to the pixel electrodes 55. At this time, the data line driving circuit 20 alternately performs application of the positive polarity and application of the negative polarity at every one horizontally scanning period.

The above-described liquid crystal device 1 operates as follows.

First, the control circuit 30 supplies the voltage VCOML or VCOMH to the common line Za of an a-th row (where a is an integer satisfying $1 \leqq a \leqq 320$).

Specifically, the voltages VCOML and VCOMH are alternately supplied to the common line Za at every one frame period. For example, when the voltage VCOML is supplied to the common line Za at one frame period, the voltage VCOMH is supplied to the common line Za at the next one frame period. Alternatively, when the voltage VCOMH is supplied to the common line Za at one frame period, the voltage VCOML is supplied to the common line Za at the next one frame period.

The different voltages are supplied to the mutually adjacent common lines Z. For example, at one horizontally scanning period, the voltage VCOMH is supplied to the common line Z(a−1), and the common lines Z(a−2) and Za are set to the floating state. At the next one horizontally scanning period, the voltage VCOML is supplied to the common line Za, and the common lines Z(a−1) and Z(a+1) are set to the floating state. Sequentially, the another next horizontally scanning period, the voltage VCOMH is supplied to the common line Z(a+1), and the common lines Za and Z(a+2) are set to the floating state.

As described above, the control circuit 30 supplies the voltage VCOML or VCOMH to the common line Za and simultaneously sets the common line Z(a−1) of (a−1) row and the common line Z(a+1) of (a+1) row to the floating state.

Next, the scanning line driving circuit 10 supplies the selection voltage to the scanning line Ya to turn all TFTs 51 connected to the scanning line Ya to the ON state and to select all pixels 50 related to the scanning line Ya.

In synchronization with the selection of the pixels 50 related to the scanning line Ya, the data line driving circuit 20 alternately supplies the data lines X1 to X240 the positive image signal and the negative image signal at every horizontally scanning period depending on the voltage of the common line Za.

Specifically, when the voltage of the common line Za is the voltage VCOML, the positive image signal is supplied to the data lines X1 to X240. Alternatively, when the voltage of the common line Za is the voltage VCOMH, the negative image signal is supplied to the data lines X1 to X240.

In this way, the data line driving circuit 20 supplies the image signal to all pixels 50 selected by the scanning line driving circuit 10 through the data lines X1 to X240 and TFTs 51 in the ON state, the image voltage based on the image signal is applied to the pixel electrodes 55. For this reason, a potential difference between the pixel electrodes 55 and the common electrodes 56 occurs, and thus a driving voltage is applied to the liquid crystal.

With the driving voltage applied to the liquid crystal, alignment or order of the liquid crystal is changed, and thus light transmitted through the liquid crystal from a backlight 90 changes. The changed light transmits the color filters 72, thereby displaying an image.

The driving voltage is applied to the liquid crystal for an interval three orders of magnitude greater than the interval of time for which the image voltage is applied by the storage capacitors 53.

Figure 4:
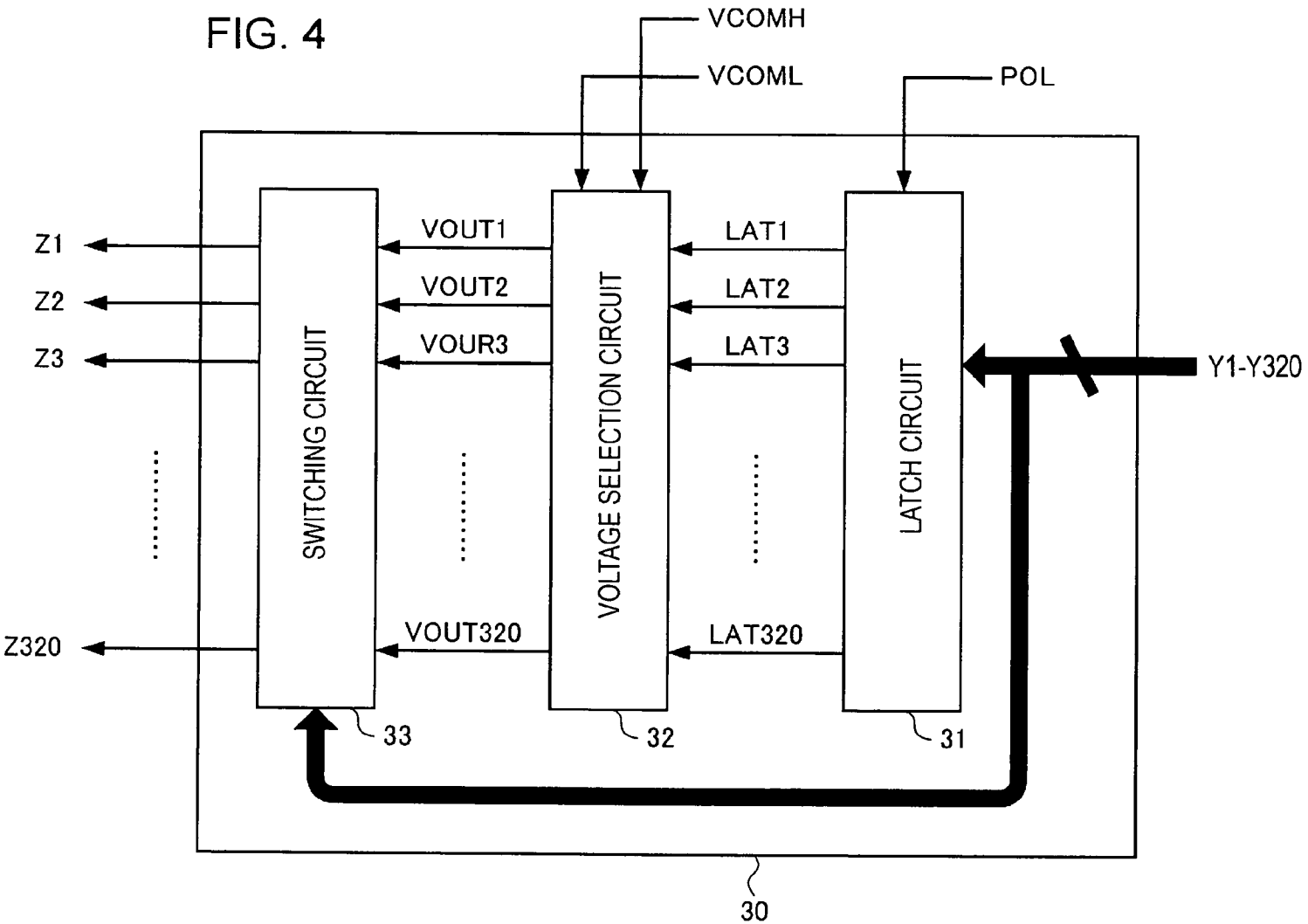
FIG. 4 is a block diagram illustrating a control circuit included by the liquid crystal device.

FIG. 4 is a block diagram illustrating the control circuit 30.

The control circuit 30 includes a latch circuit 31, the voltage selection circuit 32 that is a selecting circuit, and a switching circuit 33.

Figure 5:
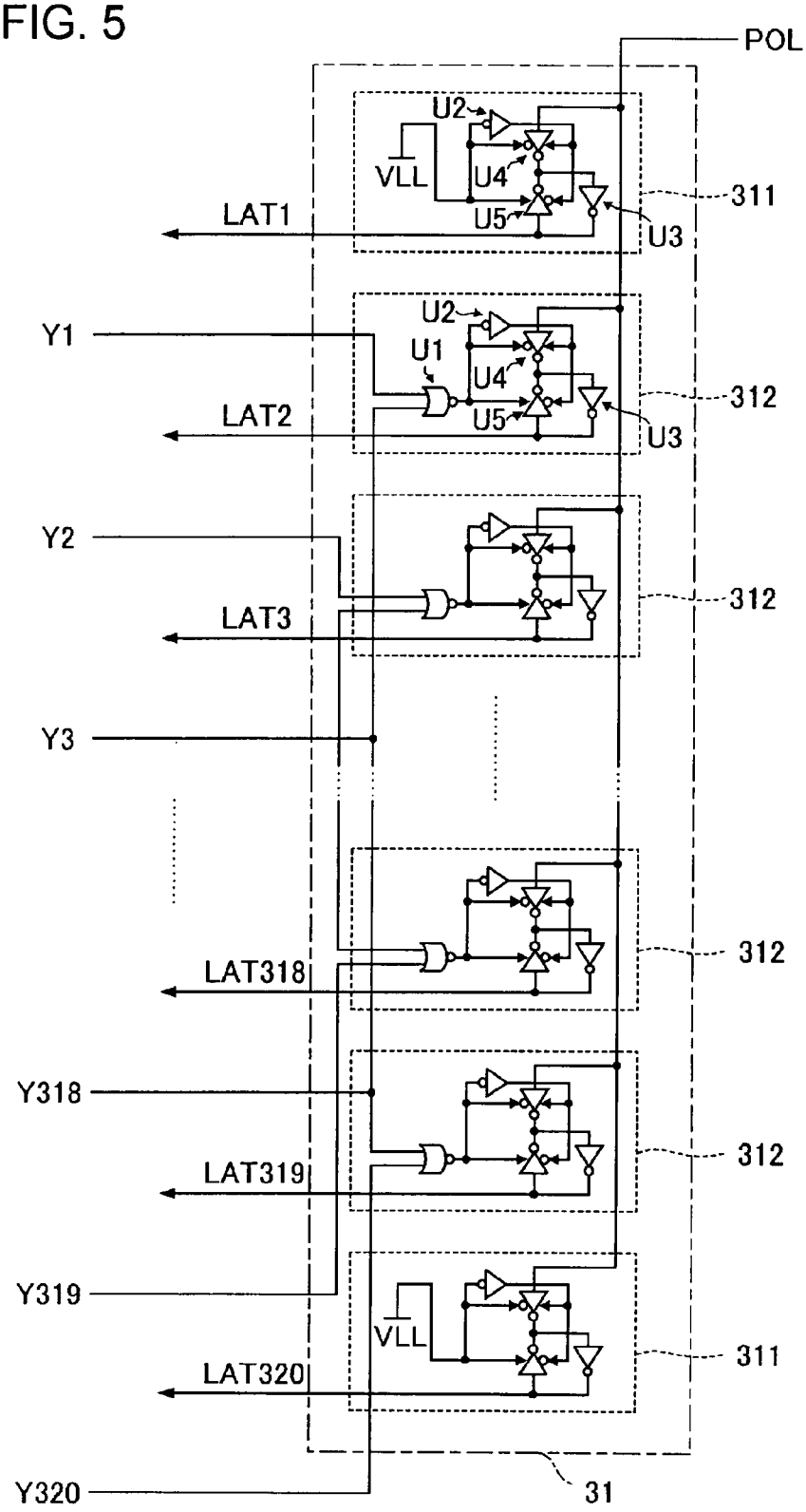
FIG. 5 is a block diagram illustrating a latch circuit included by the control circuit.

FIG. 5 is a block diagram illustrating the latch circuit 31.

The latch circuit 31 includes a first unit latch circuit 311 corresponding to the scanning lines Y1 and Y320 and a second unit latch circuit 312 corresponding to the scanning lines Y2 to Y319.

First, the second unit latch circuits 312 will be described with reference to the second unit latch circuit 312(*b*) corresponding to the scanning line Yb of a b-th row (where b is an integer satisfying 2≦b≦319).

The second unit latch circuit 312(*b*) includes an NOT-OR circuit U1 (hereinafter, referred to as an NOR circuit), a first inverter U2, a second inverter U3, a first clocked inverter U4, and a second clocked inverter U5.

Two input terminals of each NOR circuit U1 are connected to the scanning lines Y(b−1) of (b−1) row and Y(b+1) of (b+1) row. An output terminal of the NOR circuit U1 is connected to an input terminal of the first inverter U2, an inverting input control terminal of the first clocked inverter U4, and a non-inverting input control terminal of the second clocked inverter U5.

The input terminal of each first inverter U2 is connected to the output terminal of the NOR circuit U1. An output terminal of the first inverter U2 is connected to the non-inverting input control terminal of the first clocked inverter U4 and the non-inverting control terminal of the second clocked inverter U5.

A polarity signal POL is input to an input terminal of the first clocked inverter U4 and an output terminal of the first clocked inverter U4 is connected to an input terminal of the second inverter U3. The inverting input control terminal of the first clocked inverter U4 is connected to the output terminal of the NOR circuit U1 and the non-inverting input control terminal of the first clocked inverter U4 is connected to the output terminal of the first inverter U2.

The input terminal of the second inverter U3 is connected to the output terminal of the first clocked inverter U4 and an output terminal of the second clocked inverter U5. An output terminal of the second inverter U3 is connected to an input terminal of the second clocked inverter U5.

The input terminal of the second clocked inverter U5 is connected to the output terminal of the second inverter U3 and the output terminal of the second clocked inverter U5 is connected to the input terminal of the second inverter U3. An inverting input control terminal of the second clocked inverter U5 is connected to the output terminal of the first inverter U2 and the non-inverting input control terminal of the second clocked inverter U5 is connected to the output terminal of the NOR circuit U1.

The above-described second unit latch circuit 312(*b*) operates as follows.

When as the selection signal, an H level signal is supplied to at least any one of the scanning lines Y(b−1) and Y(b+1), the NOR circuit U1 constituting the second unit latch circuit 312(*b*) outputs an L level signal. The L level signal output from the NOR circuit U1 is input to the inverting input control terminal of the first clocked inverter U4, and a polarity of the L level signal is simultaneously inverted by the first inverter U2 so that the L level signal becomes the H level signal and is input to the non-inverting input control terminal of the first clocked inverter U4. In this way, the first clocked inverter U4 turns on, and inverts the polarity of the polarity signal POL to output the inverted polarity signal POL. The polarity signal POL that is output with the polarity inverted by the first clocked inverter U4 is re-inverted by the second inverter U3. The polarity signal POL of which the polarity returns is output as a latch signal LATb.

Alternatively, when as the non-selection signal, the L level signal is supplied to both the scanning lines Y(b−1) and Y(b+1), the NOR circuit U1 constituting the second unit latch circuit 312(*b*) outputs the H level signal. The H level signal output by the NOR circuit U1 is input to the non-inverting input control terminal of the second clocked inverter U5, and simultaneously a polarity of the H level signal is inverted into the L level signal by the first inverter U2 and is input to the inverting input control terminal of the second clocked inverter U5. In this way, the second clocked inverter U5 turns on, and inverts the polarity of the polarity signal POL output by the second inverter U3 to output the inverted polarity signal POL. The polarity signal POL that is output with the polarity inverted by the second clocked inverter U5 is re-inverted by the second inverter U3. The polarity signal POL of which the polarity turns is output as the latch signal LATb.

That is, when the selection signal is supplied to at least any one of the scanning lines Y(b−1) and Y(b+1), each second unit latch circuit 312(*b*) inputs the polarity signal POL and outputs the input polarity signal POL as the latch signal LATb.

Alternatively, when the non-selection signal is supplied to both the scanning lines Y(b−1) and Y(b+1), the second inverter U3 and the second clocked inverter U5 maintain the latch signal LATb, and the second unit latch circuit 312(*b*) outputs the latch signal LATb.

Next, the first unit latch circuit 311 will be described.

Each first unit latch circuit 311 includes a low-potential power VLL for outputting the L level signal instead of the NOR circuit U1, compared with each second unit latch circuit 312. The other configuration of each first unit latch circuit 311 is the same as that of each second unit latch circuit 312.

The above-described first unit latch circuit 311 operates as follows.

Each low-potential power VLL normally outputs the L level signal. The L level signal output from each low-potential power VLL is input to the inverting input control terminal of the corresponding first clocked inverter U4, and a polarity of the L level signal is simultaneously inverted by the corresponding first inverter U2 so that the H level signal is input to the non-inverting input control terminal of the corresponding first clocked inverter U4. In this way, each first clocked inverter U4 normally turns on, and inverts the polarity of the polarity signal POL to output the inverted polarity signal POL. The polarity signal POL that is output with the polarity inverted by each first clocked inverter U4 is re-inverted by the corresponding second inverter U3. The polarity signal POL of which the polarity returns is output as latch signals LAT1 and LAT320.

That is, normally, each first unit latch circuit 311 inputs the polarity signal POL and outputs the input polarity signal POL as the latch signals LAT1 and LAT320.

Figure 6:
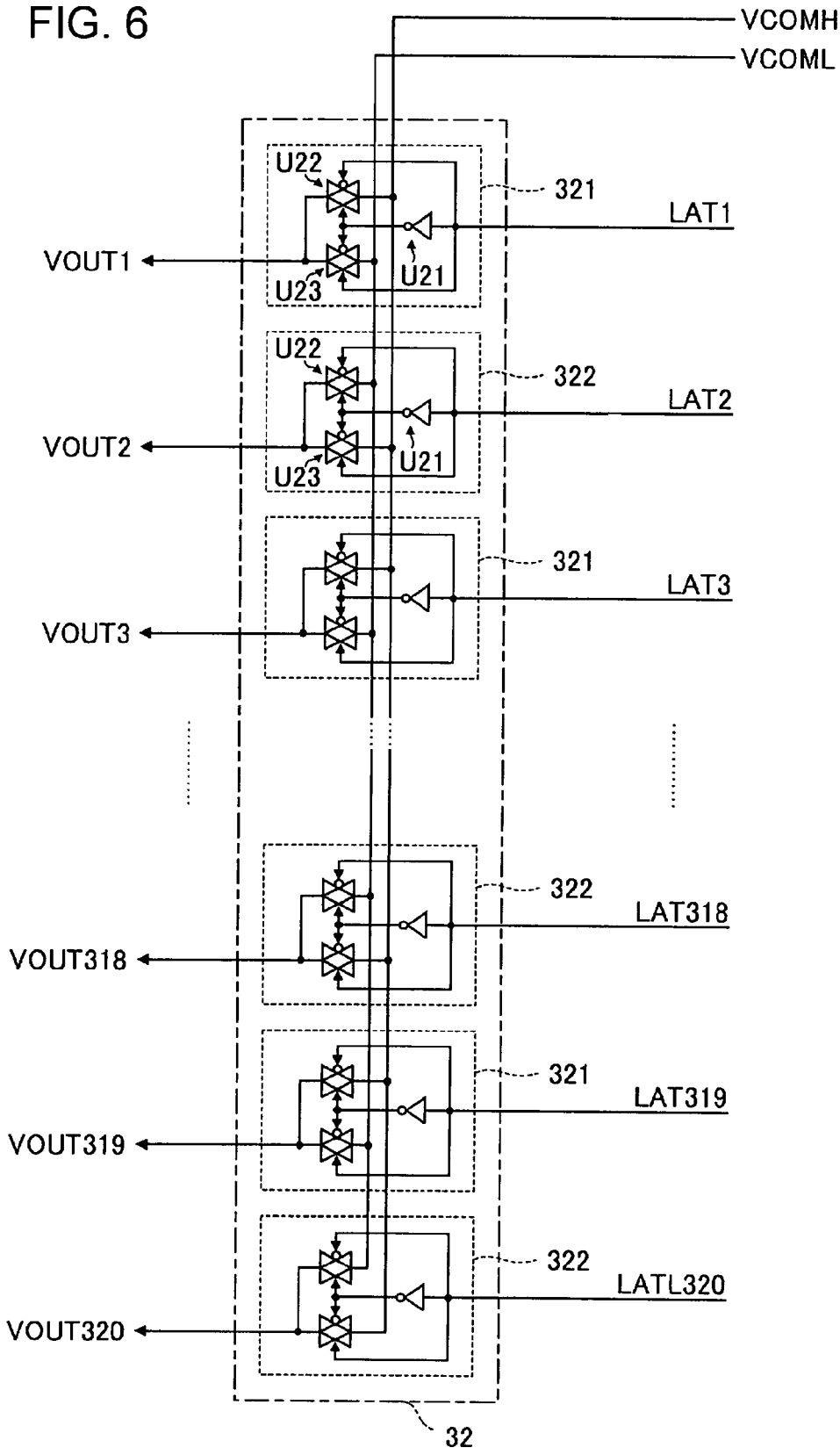
FIG. 6 is a block diagram illustrating a voltage selection circuit included by the control circuit.

FIG. 6 is a block diagram illustrating the voltage selection circuit 32.

The voltage selection circuit 32 includes first unit voltage selection circuits 321 corresponding to the scanning lines Y of uneven rows and second unit voltage selection circuits 322 corresponding to the scanning lines Y of even rows.

First, the first unit voltage selection circuits 321 will be described with reference to the first unit voltage selection circuit 321(*c*) corresponding to the scanning line Yc of a c-th row (where c is an integer satisfying 1≦c≦320).

The first unit voltage selection circuit 321(*c*) includes an inverter U21, a first transfer gate U22, and a second transfer gate U23.

A latch signal LATc output from the latch circuit 31 is input to an input terminal of the inverter U21, and a non-inverting input control terminal of the first transfer gate U22 and an inverting input control terminal of the second transfer gate U23 are connected to output terminal of the inverter U21.

The voltage VCOMH is input to an input terminal of the first transfer gate U22. The output terminal of the inverter U21 is connected to the non-inverting input control terminal of the first transfer gate U22. The latch signal LATc output from the latch circuit 31 is input to an inverting input control terminal of the first transfer gate U22.

The voltage VCOML is input to an input terminal of the second transfer gate U23. The output terminal of the inverter U21 is connected to the inverting input control terminal of the second transfer gate U23. The latch signal LATc output from the latch circuit 31 is input to a non-inverting input control terminal of the second transfer gate U23.

The above-described first unit voltage selection circuit 321(*c*) operates as follows.

When the latch signal LATc of the H level is output from the latch circuit 31, the latch signal LATc of the H level is input to the non-inverting input control terminal of the second transfer gate U23. Simultaneously, the polarity of the latch signal LATc is inverted by the inverter U21 so that the latch signal LATc becomes the L level signal and is input to the inverting input control terminal of the second transfer gate U23. In this way, the second transfer gate U23 turns on and outputs the voltage VCOML as a voltage level signal VOUTc.

Alternatively, when the latch signal LATc of the L level is output from the latch circuit 31, the latch signal LATc of the L level is input to the inverting input control terminal of the first transfer gate U22. Simultaneously, the polarity of the latch signal LATc is inverted by the inverter U21 so that the latch signal LATc becomes the H level signal and is input to the non-inverting input control terminal of the first transfer gate U22. In this way, the first transfer gate U22 turns on and outputs the voltage VCOMH as a voltage level signal VOUTc.

That is, the first unit voltage selection circuit 321(*c*) outputs the voltage VCOML as the voltage level signal VOUTc when the latch signal LATc of the H level is output from the latch circuit 31.

Alternatively, the first unit voltage selection circuit 321(C) outputs the voltage VCOMH as the voltage level signal VOUTc when the latch signal LATc of the L level is output from the latch circuit 31.

Next, the second unit voltage selection circuits 322 will be described with reference to the second unit voltage selection circuit 322(*d*) corresponding to the scanning line Yd of a d-th row (where d is an integer satisfying 1≦d≦320).

In each second unit voltage selection circuit 322(*d*), the voltages input to the input terminal of the first transfer gate U22 and input to the input terminal of the second transfer gate U23 are different, compared with each first unit voltage selection circuit 321(*c*). The other configuration of each second unit voltage selection circuit 322(*d*) is the same as that of each first unit voltage selection circuit 321(*c*).

The voltage VCOML is input to the input terminal of the first transfer gate U22 constituting the second unit voltage selection circuit 322 (*d*). In addition, the voltage VCOMH is input to the input terminal of the second transfer gate U23 constituting the second unit voltage selection circuit 322 (*d*).

The above-described second unit voltage selection circuit 322(*d*) operates as follows.

The second unit voltage selection circuit 322(*d*) outputs the voltage VCOMH as the voltage level signal VOUTc when the latch signal LATd of the H level is output from the latch circuit 31.

The second unit voltage selection circuit 322(*d*) outputs the voltage VCOML as the voltage level signal VOUTc when the latch signal LATd of the L level is output from the latch circuit 31.

Figure 7:
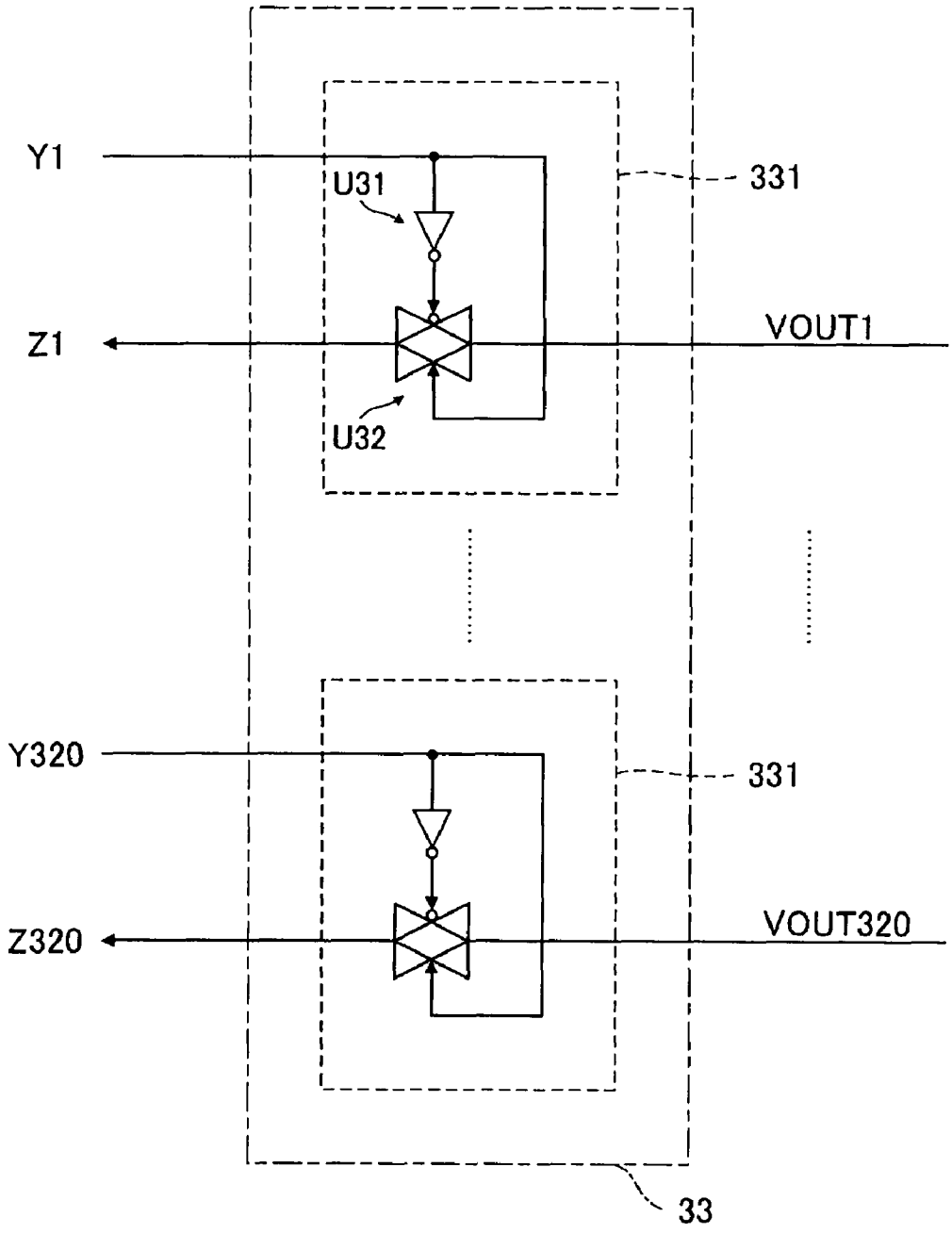
FIG. 7 is a block diagram illustrating a switching circuit included by the control circuit.

FIG. 7 is a block diagram illustrating the switching circuit 33.

The switching circuit 33 includes unit switching circuits 331 corresponding to the scanning lines Y1 to Y320.

The unit switching circuits 331 will be described with reference to the unit switching circuit 331(*e*) corresponding to the scanning line Ye of an e-th row (where e is an integer satisfying 1≦c≦320).

The unit switching circuit 331(*e*) includes an inverter U31 and a transfer gate U32.

A scanning line Ye is connected to an input terminal of the inverter U 31 and an inverting input control terminal of the transfer gate U32 is connected to an output terminal of the inverter U31.

A voltage level signal VOUTe output from the voltage selection circuit 32 is input to an input terminal of the transfer gate U32. The output terminal of the inverter U31 is connected to the inverting input control terminal of the transfer gate U32 and the scanning line Ye is connected to a non-inverting input control terminal of the transfer gate U32.

The above-described switching circuit 331(*e*) operates as follows.

When as the selection voltage, the H level signal is supplied to the scanning line Ye, the transfer gate U32 turns on and supplies the common line Ze the voltage VCOML or VCOMH as the voltage level signal VOUTe.

Alternatively, when as the selection voltage, the L level signal is supplied to the scanning line Ye, the transfer gate U32 turns off and stops supplying the common line Ze the voltage VCOML or VCOMH as the voltage level signal VOUTe. Accordingly, the common line Ze is electrically disconnect the corresponding first unit voltage selection circuit 321 or the corresponding second unit voltage selection circuit 322 corresponding to the scanning line Ye of an e-th row. Since the voltage is not supplied to the common line Ze, the common line Ze enters the floating state.

Figure 8:
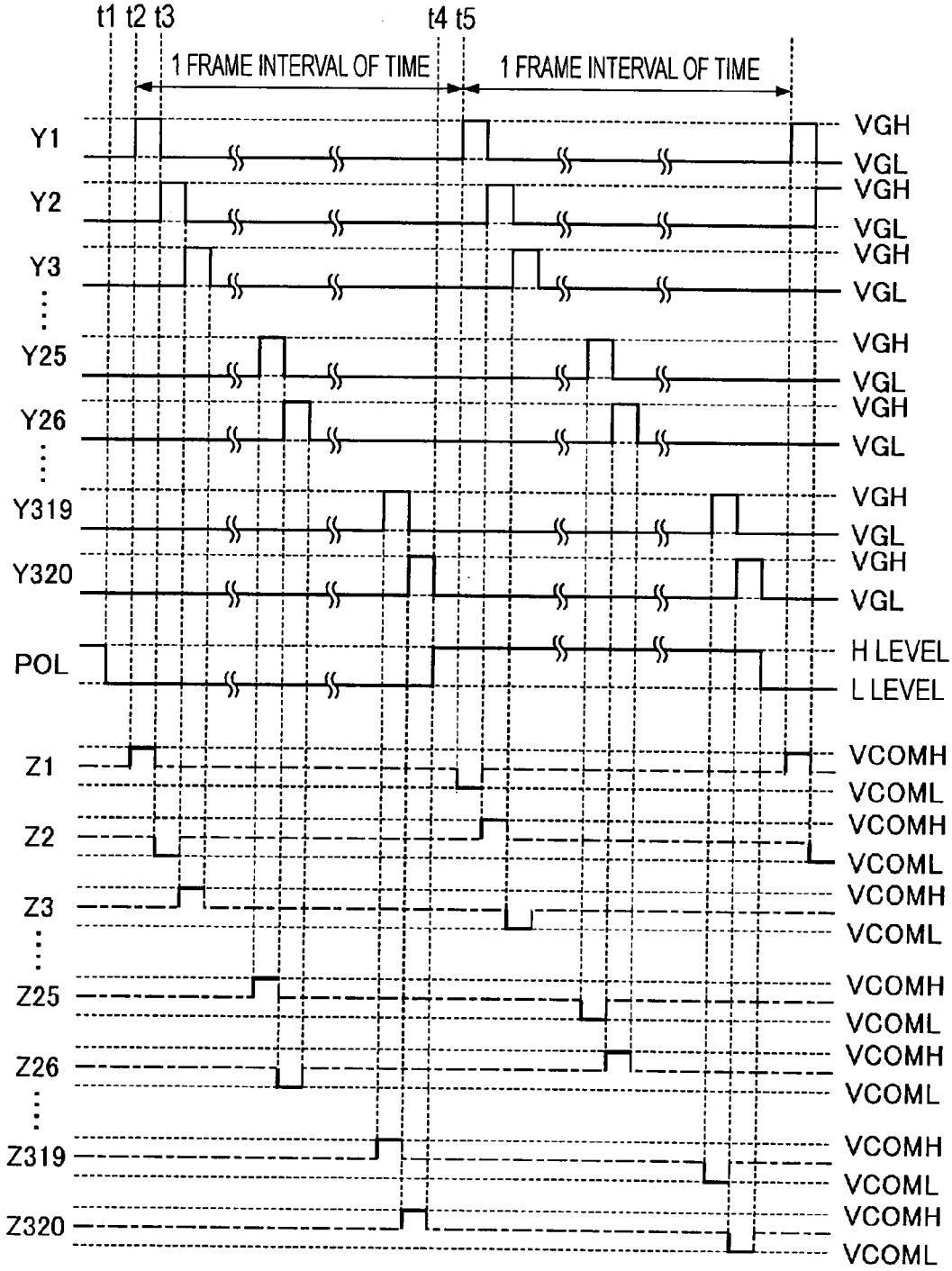
FIG. 8 shows a timing chart of the control circuit.

FIG. 8 shows a timing chart of the control circuit 30.

In FIG. 8, the single dot line denotes the floating state.

First, an operation of the control circuit 30 will be described with reference to the scanning line Y1.

At time t1, the polarity signal POL is set to the L level.

Since the polarity signal POL is at the L level at time t2, the first unit latch circuit 311 corresponding to the scanning line Y1 outputs the latch signal LAT1 of the L level of which the polarity is the same as that of the polarity signal POL. Sequentially, the first unit voltage selection circuit 321 corresponding to the scanning line Y1 outputs the voltage VCOMH as the voltage level signal VOUT1, based on the latch signal LAT1 of the L level.

At this time, the scanning line driving circuit 10 supplies the selection voltage to the scanning line Y1, and thus the voltage of the scanning line Y1 becomes the voltage VGH. Sequentially, the unit switching circuit 331 corresponding to the scanning line Y1 supplies the common line Z1 the voltage VCOMH output from the first unit voltage selection circuit 321 corresponding to the scanning line Y1.

At time t3, the scanning line driving circuit 10 supplies the non-selection voltage to the scanning line Y1. Sequentially, the unit switching circuit 331 corresponding to the scanning line Y1 stops supplying the common line Z1 the voltage VCOMH output from the first unit voltage selection circuit 321 corresponding to the scanning line Y1. Accordingly, the common line Z1 enters the floating state.

At time t4, the polarity signal POL is set to the H level.

Since the polarity signal POL is at the H level at time t5, the first unit latch circuit 311 corresponding to the scanning line Y1 outputs the latch signal LAT1 of the H level of which the polarity is the same as that of the polarity signal POL. Sequentially, the first unit voltage selection circuit 321 corresponding to the scanning line Y1 outputs the voltage VCOML as the voltage level signal VOUT1 based on the latch signal LAT1 of the H level.

At this time, the scanning line driving circuit 10 supplies the selection voltage to the scanning line Y1, and thus the voltage of the scanning line Y1 becomes the voltage VGH. Sequentially, the unit switching circuit 331 corresponding to the scanning line Y1 supplies the common line Z1 the voltage VCOML output from the first unit voltage selection circuit 321 corresponding to the scanning line Y1.

At time t5, the scanning line driving circuit 10 supplies the non-selection voltage to the scanning line Y1. Sequentially, the unit switching circuit 331 corresponding to the scanning line Y1 stops supplying the common line Z1 the voltage VCOMH output from the first unit voltage selection circuit 321 corresponding to the scanning line Y1. Accordingly, the common line Z1 enters the floating state.

Next, the control circuit 30 will be described with reference to the uneven scanning lines of the scanning lines Y2 to Y320.

When the voltage VCOMH is supplied to the common line Z1, at the same one frame period, the control circuit 30 supplies the voltage VCOMH to the common line Zf during the time the selection voltage is supplied to the scanning line Yf (where f is an uneven integer satisfying $2 \leqq f \leqq 320$). Alternatively, when the voltage VCOML is supplied to the common line Z1, at the same one frame period, the control circuit 30 supplies the voltage VCOML to the common line Zf during the time the selection voltage is supplied to the scanning line Yf.

Next, the control circuit 30 will be described with reference to the even scanning lines of the scanning lines Y2 to Y320.

When the voltage VCOMH is supplied to the common line Z1, at the same one frame period, the control circuit 30 supplies the voltage VCOML to the common line Zg during the time the selection voltage is supplied to the scanning line Yg (where g is an even integer satisfying $2 \leqq g \leqq 320$). Alternatively, when the voltage VCOML is supplied to the common line Z1, at the same one frame period, the control circuit 30 supplies the voltage VCOMH to the common line Zg during the time the selection voltage is supplied to the scanning line Yg.

An operation of the liquid crystal device 1 having the above-described control circuit 30 will be described with reference to FIGS. 9 and 10.

Figure 9:
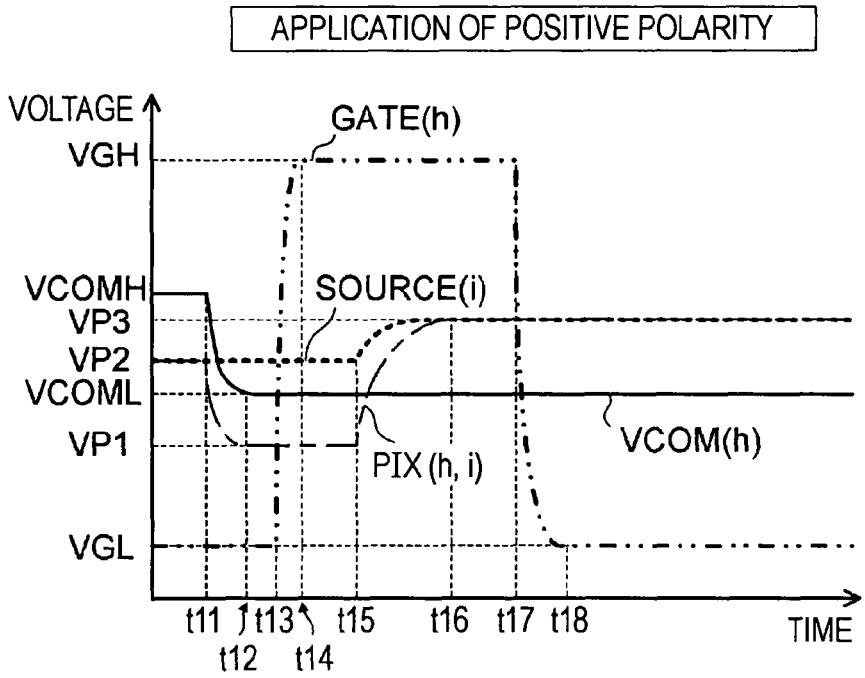
FIG. 9 is a timing chart for illustrating an application of a positive polarity in the liquid crystal device.

FIG. 9 is a timing chart for illustrating an application of a positive polarity voltage. FIG. 10 is a timing chart for illustrating an application of a negative polarity voltage.

Figure 10:
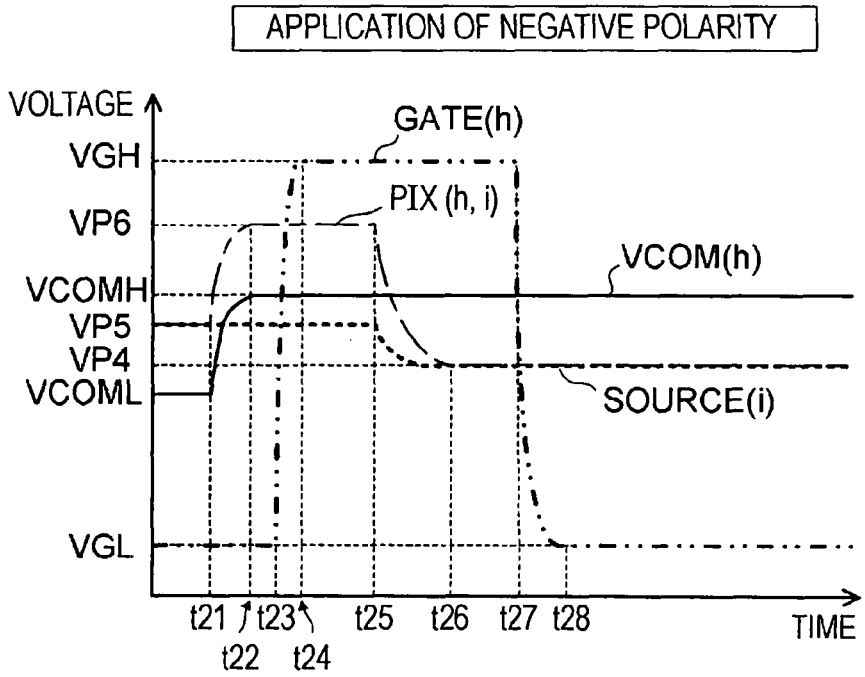
FIG. 10 is a timing chart for illustrating an application of a negative polarity in the liquid crystal device.

In FIGS. 9 and 10, GATE(h) denotes the voltage of the scanning line Yh of an h-th row (where h is an integer satisfying $1 \leqq h \leqq 320$) and SOURCE(i) denotes the voltage of an data line Xi of an i-th column (where i is an integer satisfying $1 \leqq I \leqq 240$). PIX(h, i) denotes the voltage of pixel electrode 55 of the pixel 50 in the h-th row and the i-th column corresponding to an intersection of the scanning line Yh of the h-th row and the data line Xi of the i-th column. VCOM(h) denotes the voltage of the common electrodes 56 connected to the common line Zh of the h-th row.

First, an operation of the liquid crystal device 1 at the time of application of the positive polarity voltage will be described with reference with FIG. 9.

At time t11, the control circuit 30 supplies the voltage VCOML to the common line Zh. Then, a voltage VCOM(h) of the common electrodes 56 connected to the common line Zh decreases and thus becomes the voltage VCOML at time t12.

When the voltage VCOM(h) of the common electrodes 56 connected to the common line Zh decreases, the voltage PIX (h, i) of the pixel electrode 55 of the pixel 50 with the h-th row and the i-th column decreases so as to maintain a potential difference between the voltage VCOM(h) and the voltage PIX(h, i). In this way, the voltage PIX(h, i) of the pixel electrode 55 of the pixel 50 with the h-th row and the i-th column decreases and thus becomes a voltage VP1 at time t12.

At time t13, the scanning line driving circuit 10 supplies the selection voltage to the scanning line Yh. Then, a voltage GATE(h) of the scanning line Yh increases and thus becomes a voltage VGH at time t14. Accordingly, TFTs 51 connected to the scanning line Yh all turn on.

At time t15, the data line driving circuit 20 supplies the positive image signal to the data line Xi. Then, the voltage SOURCE(i) of the data line Xi increases and thus becomes a voltage VP3 at time t16.

The voltage SOURCE(i) of the data line Xi that is an image voltage based on the positive image signal is applied to the pixel electrode 55 of the pixel 50 with the h-th row and the i-th column through the ON state TFTs 51 connected to the scanning line Yh. For this reason, the voltage PIX(h, i) of the pixel electrode 55 of the pixel 50 with the h-th row and the i-th column increases and thus becomes the voltage VP3 that is the same as the voltage SOURCE(i) of the data line Xi at time t16.

At time t17, the scanning line driving circuit 10 stops supplying the selection voltage to the scanning line Yh. Then, the voltage GATE(h) of the scanning line Yh decreases and thus becomes a voltage. VGL at time t18. In this way, TFTs 51 connected to the scanning line Yh all turn off.

Next, an operation of the liquid crystal device 1 at the time of application of the negative polarity voltage will be described with reference to FIG. 10.

At time t21, the control circuit 30 supplies the voltage VCOMH to the common line Zh. Then, the voltage VCOM(h) of the common electrodes 56 connected to the common line Zh decreases and thus becomes the voltage VCOMH at time t22.

When the voltage VCOM(h) of the common electrodes 56 connected to the common line Zh increases, the voltage PIX (h, i) of the pixel electrode 55 of the pixel 50 with the h-th row and the i-th column increases so as to maintain a potential difference between the voltage VCOM(h) and the voltage PIX(h, i). In this way, the voltage PIX(h, i) of the pixel electrode 55 of the pixel 50 with the h-th row and the i-th column increases and thus becomes a voltage VP6 at time t22.

At time t23, the scanning line driving circuit 10 supplies the selection voltage to the scanning line Yh. Then, the voltage GATE(h) of the scanning line Yh increases and thus becomes a voltage VGH at time t24. Accordingly, TFTs 51 connected to the scanning line Yh all turn on.

At time t25, the data line driving circuit 20 supplies the negative polarity image signal to the data line Xi. Then, the voltage SOURCE(i) of the data line Xi decreases and thus becomes a voltage VP4 at time t26.

The voltage SOURCE(i) of the data line Xi that is an image voltage based on the negative image signal is applied to the pixel electrode 55 of the pixel 50 with the h-th row and the i-th column through the ON state TFTs 51 connected to the scanning line Yh. For this reason, the voltage PIX(h, i) of the pixel electrode 55 of the pixel 50 with the h-th row and the i-th column decreases and thus becomes the voltage VP4 that is the same as the voltage SOURCE(i) of the data line Xi at time t26.

At time t27, the scanning line driving circuit 10 stops supplying the selection voltage to the scanning line Yh. Then, the voltage GATE(h) of the scanning line Yh decreases and thus becomes a voltage VGL at time t28. In this way, TFTs 51 connected to the scanning line Yh all turn off.

According to this embodiment, the following advantages are as follows.

(1) After the voltage VCOML is supplied to the common electrodes 56, the positive polarity voltage is applied, and after the voltage VCOMH is supplied to the common electrodes 56, the negative polarity voltage is supplied. For this reason, as described in the known example, the charges do not move between the storage capacitors 53 and the pixel capacitors 54. Accordingly, even when the irregularity in characteristic happens in the storage capacitors 53, the irregularity does not happen in the voltage of the pixel electrodes 55. As a result, the irregularity can be prevented in a gray scale level of each pixel 50, thereby preventing a display quality from being deteriorated.

(2) The voltage of the common electrodes 56 is changed to the voltage VCOML or VCOMH. For this reason, as described in the known example, it is not necessary to change the voltage of each capacitance line connected to one electrode of each storage capacitor 53 differently from the voltage of the each pixel electrode 55 and each common electrode 56 included by the corresponding pixel capacitor 54. That is, since the voltage of the one electrode of each storage capacitor 53 can be changed similarly with the voltage of each common electrode 56, the one electrode of each storage capacitor 53 and each common electrode 56 can be incorporated. Moreover, since the other electrode of each storage capacitor 53 is connected to the corresponding pixel electrode 55, as described above, the potential of the other electrode of each storage capacitor 53 is the same as that of the corresponding pixel electrode 55, and thus the other electrode of each storage capacitor 53 and the corresponding pixel electrode 55 can be incorporated. As a result, since the storage capacitors 53 and the pixel electrodes 54 can be incorporated, it is possible to embody the liquid crystal device 1 according to the invention including the pixel electrodes 55 and the common electrodes 56 constituting the pixel capacitors 54 on an element substrate 60 of the element substrate 60 and a counter substrate 70 with the liquid crystal interposed therebetween.

(3) The common electrodes 56 are provided to be partitioned every horizontal line. In addition, the control circuit 30 supplies the voltage VCOML or the voltage VCOMH to the common electrodes 56, and two common electrodes 56 adjacent to the common electrodes 56 supplied with the voltage VCOML or VCOMH is set to a floating state. For this reason, the capacitive coupling occurs between the common electrodes 56 supplied with the voltage VCOML or VCOMH and the common electrodes 56 in the floating state. However, since the common electrodes 56 of one side are in the floating state, interfering with the change in the voltage of the common electrodes 56 supplied with the voltage VCOML or VCOMH becomes small. Accordingly, when the voltage VCOML or VCOMH is supplied to the common electrodes 56, the time required to change the voltage of the common electrodes 56 to the predetermined voltage can be prevented from being longer, thereby further preventing the display quality from being deteriorated. Moreover, when the common electrodes 56 are set to the floating state, the supply of the voltage to the common electrodes 56 stops. As a result, it is possible to reduce the consumption power.

(4) On the control circuit 30, the first unit latch circuit 311 or the second unit latch circuit 312 constituting the latch circuit 31, the first unit voltage selection circuits 321 or the second unit voltage selection circuits 322 constituting the voltage selection circuit 32, and the unit switching circuits 331 constituting the switching circuit 33, corresponding to the scanning lines Y1 and Y320, are provided. For this reason, the control circuit 30 can selectively supply the voltage VCOML or the voltage VCOMH to each common electrode 56 or set each common electrode 56 to the floating state. As a result, the same advantages as described above are gained.

Second Embodiment

Figure 11:
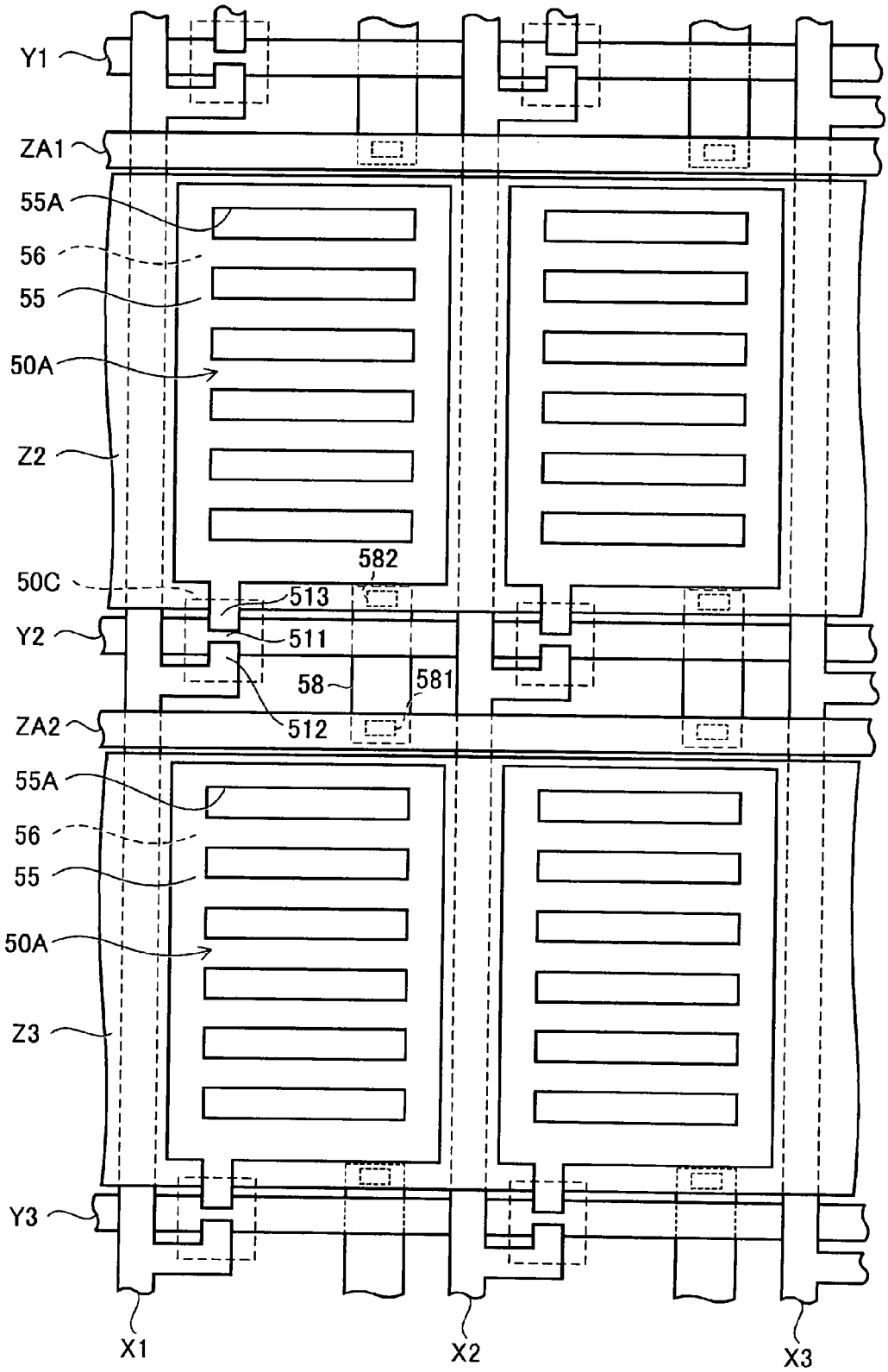
FIG. 11 is an enlarged top view illustrating pixels according to a second embodiment of the invention.

FIG. 11 is an enlarged top view illustrating pixels 50A according to a second embodiment of the invention.

In the second embodiment, the pixels 50A is different from the pixels 50 according to the first embodiment in that the pixels 50A further includes supplementary common lines ZA and contact portions 58. The other configuration is the same as that according to the first embodiment, and the description will be omitted.

The supplementary common lines ZA are formed of conductive metal and are provided in correspondence with the common electrodes 56 partitioned every horizontal line. The supplementary common lines ZA are formed along the scanning lines Y.

The contact portions 58 are formed of conductive metal and connected to the supplementary common lines ZA in areas 581. In addition, the contact portions 58 are connected to the common electrodes 56 and the common lines Z in areas 582.

According to this embodiment, the following advantages are gained.

(5) The supplementary common lines ZA formed of conductive metal are provided in corresponding with the common electrodes 56 electrically partitioned every horizontal line. In addition, the common electrodes 56, the common lines Z, and the supplementary common lines ZA are connected each other through the contact portions 58 formed of conductive metal. Accordingly, it is possible to allow a time constant of the common electrodes 56 and the common lines Z to be small.

Modified Embodiment

The invention is not limited to the above-described embodiments, but may be modified or improved within the scope of the gist of the invention.

For example, in the above-described embodiments, the scanning lines Y of 320 rows and the data lines X of 240 columns are provided, but the invention is not limited thereto. For example, the scanning line Y of 480 rows and the data lines X of 640 columns may be provided.

In the above-described embodiments, the transmissive display is carried out, but the invention is not limited thereto. For example, transflective display combining the transmissive display that uses light from the backlight 90 and a reflective display that uses reflected light of outside light may be carried out.

In the above-described embodiments, the liquid crystal operate in the normally black mode, but the invention is not limited thereto. For example, the liquid crystal may operate in a normally white mode.

In the above-described embodiments, as TFTs, TFTs 51 formed of amorphous silicon are provided, but the invention is not limited thereto. For example, the TFT formed low-temperature silicon may be provided.

In the above-described embodiments, the second insulating film 64 is formed on the common electrodes 56 and the pixel electrodes 55 are formed on the second insulating film 64, but the invention is not limited thereto. For example, the second insulating film 64 may be formed on the pixel electrodes 55 and the common electrodes 56 may be formed on the second insulating film 64.

In the above-described embodiments, the liquid crystal device 1 is an FFS-type liquid crystal device, but the invention is not limited thereto. For example, an IPS-type liquid crystal device may be provided.

In the above-described embodiments, the common electrodes 56 are provided at every horizontal line, but the invention is not limited thereto. For example, the common electrodes 56 may be provided to be partitioned every two horizontal lines or at every three horizontal lines. In this case, when the common electrodes 56 are provided to be partitioned every two horizontal lines, the control circuit 30 and 30A alternately supply the voltage VCOML and VCOMH to two common lines Z connected to the corresponding common electrodes 56. In addition, the data line driving circuit 20 alternately performs application of the positive polarity voltage and application of the negative polarity voltage at every two horizontal lines corresponding to the common electrodes 56.

Applied Embodiment

Figure 12:
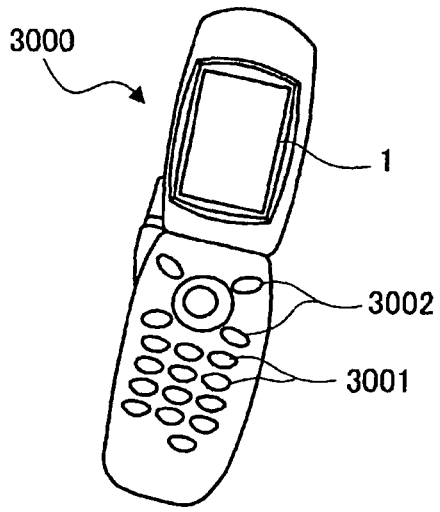
FIG. 12 is a perspective view illustrating a configuration of a cellular phone to which the above-described liquid crystal device is applied.
Figure 13:
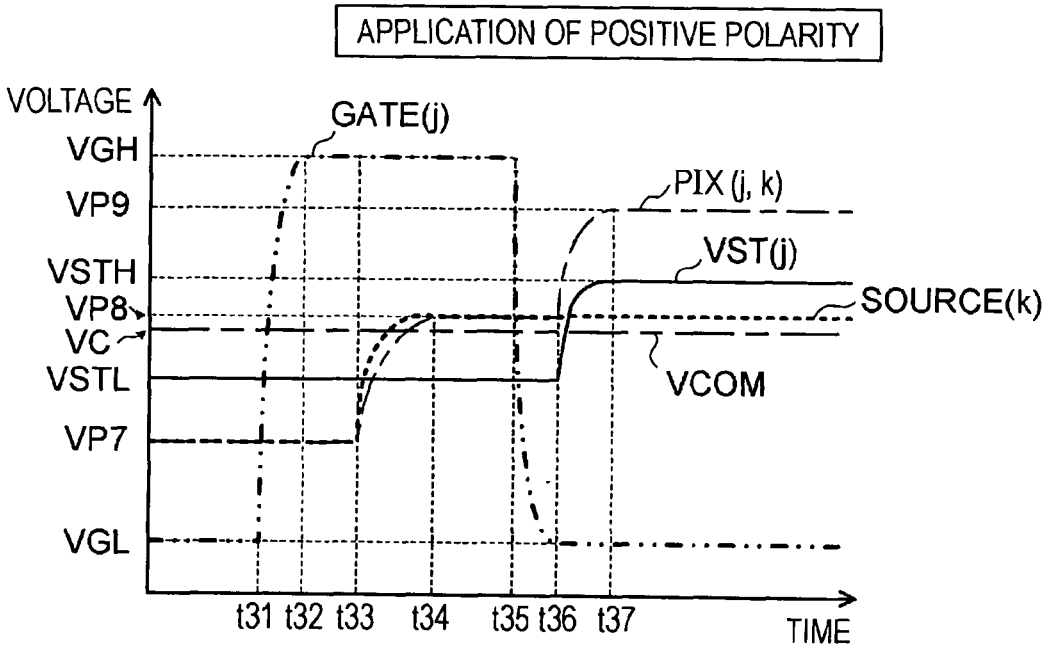
FIG. 13 is a timing chart for illustrating an application of the positive polarity in the liquid crystal of the known example.
Figure 14:
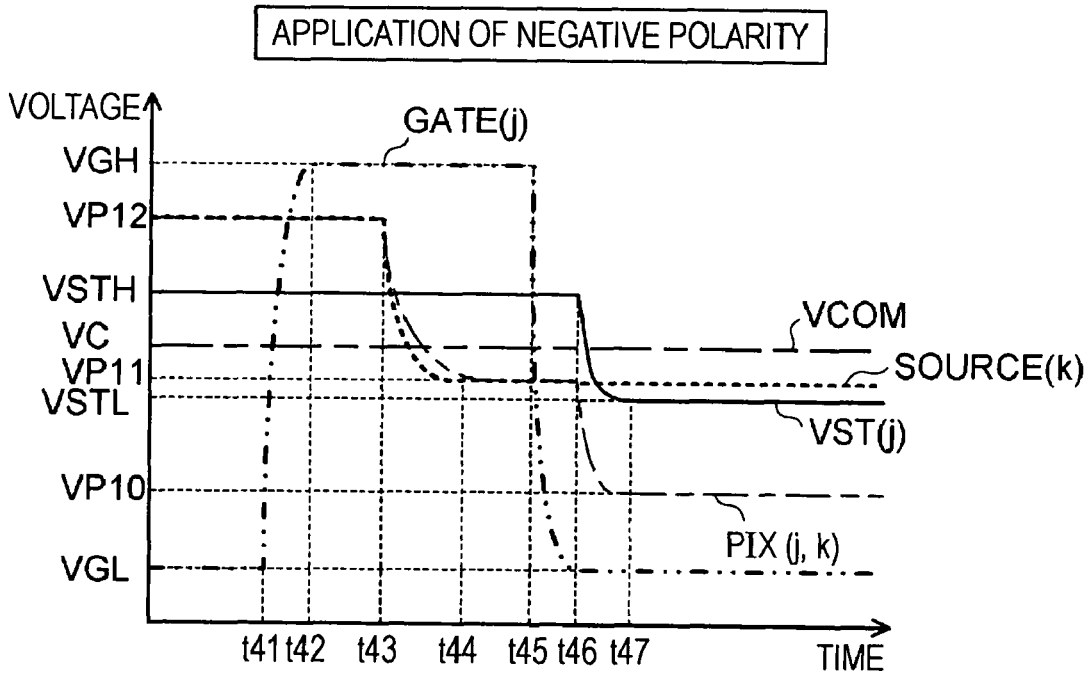
FIG. 14 is a timing chart for illustrating an application of the negative polarity in the liquid crystal of the known example.

An electronic apparatus to which the liquid crystal device 1 according to the above-described first embodiment is applied will be described. FIG. 12 is a perspective view illustrating a configuration of a cellular phone to which the liquid crystal device 1 is applied. A cellular phone 3000 includes a plurality operation buttons 3001, scroll buttons 3002, and the liquid crystal device 1. An image displayed on the liquid crystal device 1 is scrolled by operating the scroll buttons 3002.

The electronic apparatus to which the liquid crystal device 1 is applied includes a personal computer, an information portable terminal, a digital still camera, a liquid crystal television, a view finder type or monitor direct vision-type video tape recorder, a car navigation apparatus, a pager, an electronic pocket book, a calculator, a word processor, a work station, a television phone, a POS terminal, a touch panel and the like. As a display portion of the various types of electronic apparatus, the above-described liquid crystal device is applicable.

The entire disclosure of Japanese Patent Application No. 2006-261101, filed Sep. 26, 2006 is expressly incorporated by reference herein.

What is claimed is:

1. A driving circuit for driving a liquid crystal device that has a first substrate including a plurality of scanning lines, a plurality of data lines, and a plurality of pixel electrodes and a plurality of common electrodes arranged to correspond to intersections between the plurality of scanning lines and the plurality of data lines, a second substrate disposed opposite the first substrate, and liquid crystal interposed between the first substrate and the second substrate, the common electrodes being electrically partitioned every horizontal line, the driving circuit comprising:

a control circuit that alternately supplies a first voltage and a second voltage being higher than the first voltage to the common electrodes at predetermined interval of time and that sets the common electrodes to a floating state, the control circuit including a plurality of unit control circuits which are provided to correspond to the plurality of scanning lines and which are supplied with a polarity signal for selecting the first voltage or the second voltage, each unit control circuit including:

a latch circuit that maintains the polarity signal when the scanning line driving circuit supplies the selection voltage to the scanning line adjacent to the scanning line corresponding to the unit control circuit, the latch circuit including a plurality of latch unit circuits, some of the latch unit circuits receiving inputs from two scanning lines that are adjacent to the scanning line to which the unit control circuit corresponds;

a selection circuit that selectively outputs one of the first voltage and the second voltage on the basis of the polarity signal maintained by the latch circuit; and a switching circuit that electrically connects the selection circuit to the common electrode when one of the first voltage and the second voltage output from the selection circuit is supplied to the common electrodes, and electrically disconnects the selection circuit from the common electrodes when the common electrodes are set to the floating state;

a scanning line driving circuit that sequentially supplies a selection voltage for selecting a scanning line to the plurality of scanning lines; and a data line driving circuit that alternately supplies a positive image signal having a potential higher than the first voltage and a negative image signal having a potential lower than the second voltage to the plurality of data lines at a predetermined interval of time when the scanning lines are selected, wherein the control circuit supplies the first voltage to the common electrodes and sets at least one common electrode among the common electrodes adjacent to the common electrodes supplied with the first voltage to the floating state, then the scanning line driving circuit supplies the selection voltage to the scanning lines, and the data line driving circuit supplies the positive image signal to the data lines; and wherein the control circuit supplies the second voltage to the common electrodes and sets at least one common electrode among the common electrodes adjacent to the common electrodes supplied with the second voltage to the floating state, then the scanning line driving circuit supplies the selection voltage to the scanning lines, and the data line driving circuit supplies the negative image signal to the data lines.

2. A liquid crystal device comprising the driving circuit according to claim 1.

3. An electronic apparatus comprising the liquid crystal device according to claim 2.

4. A method of driving a liquid crystal device that has a first substrate including a plurality of scanning lines, a plurality of data lines, a plurality of pixel electrodes and a plurality of common electrodes arranged to correspond to intersections between the plurality of scanning lines and the plurality of data lines, a second substrate disposed opposite the first substrate, and liquid crystal interposed between the first substrate and the second substrate, wherein a control circuit for alternately supplying a first voltage and a second voltage being higher than the first voltage to the common electrodes at a predetermined interval of time and for setting the common electrodes to a floating state including a plurality of unit control circuits wherein each unit control circuit includes a latch circuit including a plurality of unit latch circuits where some of the latch unit circuits receive inputs from two scanning lines that are adjacent to the scanning line to which the unit control circuit corresponds, a selection circuit, and a switching circuit, a scanning line driving circuit for sequentially supplying a selection voltage for selecting a scanning line to the plurality of scanning lines; and a data line driving circuit for alternately supplying a positive image signal having a potential higher than the first voltage and a negative image signal having a potential lower than the second voltage to the plurality of data lines at a predetermined interval of time when selecting the scanning lines are provided, the method comprising:

maintaining the polarity signal when the scanning line driving circuit supplies the selection voltage to the scanning line adjacent to the scanning line corresponding to the unit control circuit, using the latch circuit;

outputting one of the first voltage and the second voltage on the basis of the polarity signal maintained by the latch circuit, using the selection circuit;

electrically connecting the selection circuit to the common electrode when one of the first voltage and the second voltage output from the selection circuit is supplied to the common electrodes, and electrically disconnecting the selection circuit from the common electrodes when the common electrodes are set to the floating state, using the switching circuit;

applying a positive polarity sequence in which the control circuit supplies the first voltage to the common electrodes and sets at least one common electrode among the common electrodes adjacent to the common electrode supplied with the first voltage to the floating state, then the scanning line driving circuit supplies the selection voltage to the scanning lines and the data line driving circuit supplies the positive image signal to the data lines; and applying a negative polarity sequence in which the control circuit supplies the second voltage to the common electrodes and sets at least one common electrode among the common electrodes adjacent to the common electrode supplied with the second voltage to the floating state, then the scanning line driving circuit supplies the selection voltage to the scanning lines, and the data line driving circuit supplies the negative image signal to the data lines.

5. The driving circuit according to claim 1, wherein each latch unit circuit outputs a latch signal corresponding to the polarity signal;

the selection circuit includes a plurality of unit selection circuits which receive the latch signal as an input, the selection circuit outputs a voltage level signal corresponding to the first voltage and the second voltage; and the switching circuit includes a plurality of unit switching circuits which receive the voltage level signal and the selection signal as inputs, the switching circuit outputs the voltage level signal.

6. The driving circuit according to claim 5, wherein each latch unit circuit includes a first inverter, a second inverter, a first clocked inverter and a second clocked inverter;

each unit selection circuit includes an inverter, a first transfer gate and a second transfer gate; and each unit switching circuit includes an inverter and a transfer gate.

* * * * *